US011400508B2

(12) United States Patent
Gregory et al.

(10) Patent No.: US 11,400,508 B2
(45) **Date of Patent: *Aug. 2, 2022**

(54) OUTWARD DIRECTION PIPE FITTING SWAGE MACHINE SYSTEMS AND METHODS

(71) Applicant: Trinity Bay Equipment Holdings, LLC, Houston, TX (US)

(72) Inventors: David Michael Gregory, Houston, TX (US); Richard Charles Lawrence, Mont Belvieu, TX (US); John Paul Leger, Baytown, TX (US); Mikel Lee Lewis, Baytown, TX (US)

(73) Assignee: Trinity Bay Equipment Holdings, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/341,454

(22) Filed: Jun. 8, 2021

(65) Prior Publication Data

US 2021/0370380 A1 Dec. 2, 2021

Related U.S. Application Data

(63) Continuation of application No. 16/886,525, filed on May 28, 2020, now Pat. No. 11,065,670.

(51) Int. Cl.
*B21D 39/04* (2006.01)

(52) U.S. Cl.
CPC ..... *B21D 39/046* (2013.01)

(58) Field of Classification Search
CPC ..... B21J 7/18; B21D 39/04; B21D 39/046; B21D 39/044; B21D 39/048; B23P 19/02;
(Continued)

(56) References Cited

U.S. PATENT DOCUMENTS 4,418,458 A * 12/1983 Hunter ..... B21D 39/04 29/237
7,984,538 B2 7/2011 McKay
(Continued)

FOREIGN PATENT DOCUMENTS

WO 2019165218 A1 8/2019

OTHER PUBLICATIONS

Notification of Transmittal of the International Search Report and the Written Opinion of the International Searching Authority for Application No. PCT/US21/35027 dated Aug. 31, 2021.
(Continued)

*Primary Examiner* — Lee A Holly
(74) *Attorney, Agent, or Firm* — Conrad J. Hsu

(57) ABSTRACT

Techniques for implementing and/or operating a system that includes a pipe fitting to be secured to a pipe segment, in which the pipe fitting includes a grab ring having a grab notch and a fitting jacket to be conformally deformed around tubing of the pipe segment to facilitate securing the pipe fitting to the pipe segment. The system includes a swage machine, which includes a grab plate having a grab tab that matingly interlocks with the grab notch to facilitate securing the pipe fitting to the swage machine, a die plate including a die that opens away from the grab plate, and a swaging actuator secured to the die plate. The swage machine operates the swaging actuator to move the die plate over the fitting jacket in an outwardly axial direction away from the grab plate to facilitate conformally deforming the fitting jacket around the tubing of the pipe segment.

10 Claims, 13 Drawing Sheets

(58) Field of Classification Search
CPC ..... B23P 19/027; F16L 13/161; F16L 13/146; F16L 33/2078; Y10T 29/53996; Y10T 29/49913; Y10T 29/49936
See application file for complete search history.

(56) References Cited

U.S. PATENT DOCUMENTS

| | | | | |
|---|---|---|---|---|
| 8,631,553 | B2 * | 1/2014 | Gleim ..... | B21D 39/04 29/521 |
| 9,604,273 | B1 | 3/2017 | Hogan | |
| 11,065,669 | B1 | 7/2021 | Gregory et al. | |
| 11,065,670 | B1 | 7/2021 | Gregory et al. | |
| 2011/0132059 | A1 | 6/2011 | Gleim | |
| 2017/0205007 | A1 | 7/2017 | Hegler et al. | |

OTHER PUBLICATIONS

Pakistan Examination Report for Application No. 391/2021, dated Jan. 31, 2022.

* cited by examiner

OUTWARD DIRECTION PIPE FITTING SWAGE MACHINE SYSTEMS AND METHODS

CROSS-REFERENCE

The present disclosure is a continuation of U.S. patent application Ser. No. 16/886,525, entitled "OUTWARD DIRECTION PIPE FITTING SWAGE MACHINE SYSTEMS AND METHODS" and filed May 28, 2020, which is incorporated herein by reference in its entirety for all purposes.

BACKGROUND

The present disclosure generally relates to pipeline systems and, more particularly, to special-purpose deployment equipment—namely a swage machine—that may be implemented and/or operated to facilitate securing a pipe fitting to one or more pipe segments deployed in a pipeline system.

Pipeline systems are often implemented and/or operated to facilitate transporting (e.g., conveying) fluid, such as liquid and/or gas, from a fluid source to a fluid destination. For example, a pipeline system may be used to transport one or more hydrocarbons, such as crude oil, petroleum, natural gas, or any combination thereof. Additionally or alternatively, a pipeline system may be used to transport one or more other types of fluid, such as produced water, fresh water, fracturing fluid, flowback fluid, carbon dioxide, or any combination thereof.

To facilitate transporting fluid, a pipeline system may include one or more pipe segments in addition to one or more pipe (e.g., midline and/or end) fittings (e.g., connectors), for example, which are used to fluidly couple a pipe segment to another pipe segment, to a fluid source, and/or to a fluid destination. Generally, a pipe segment includes tubing, which defines (e.g., encloses) a pipe bore that provides a primary fluid conveyance (e.g., flow) path through the pipe segment. More specifically, the tubing of a pipe segment may be implemented to facilitate isolating (e.g., insulating) fluid being conveyed within its pipe bore from environmental conditions external to the pipe segment, for example, to reduce the likelihood of the conveyed (e.g., bore) fluid being lost to the external environmental conditions and/or the external environmental conditions contaminating the conveyed fluid.

Additionally, in some instances, a pipe fitting may be implemented to be secured to a pipe segment via swaging techniques, which conformally deform at least a portion of the pipe fitting around the tubing of the pipe segment such that the portion of the pipe fitting engages the pipe segment tubing. To facilitate enabling the engagement between the pipe fitting and the pipe segment tubing to secure the pipe segment to the pipe fitting, the pipe fitting may be implemented using a relatively rigid material, such as metal. However, at least in some instances, the amount of force sufficient to conformally deform a pipe fitting implemented using a relatively rigid material around the tubing of a pipe segment may potentially limit the efficiency with which the pipe fitting is secured to the pipe segment and, thus, potentially the deployment efficiency of a pipeline system in which the pipe fitting and the pipe segment are to be deployed.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one embodiment, a system includes a pipe fitting to be secured to a pipe segment, in which the pipe fitting includes a grab ring having a grab notch and a fitting jacket to be conformally deformed around tubing of the pipe segment that defines a pipe bore and a fluid conduit implemented in a tubing annulus of the tubing to facilitate securing the pipe fitting to the pipe segment. Additionally, the system includes a swage machine, which includes a grab plate having a grab tab that matingly interlocks with the grab notch on the grab ring of the pipe fitting to facilitate securing the pipe fitting to the swage machine, a die plate including a die that opens away from the grab plate, and a swaging actuator secured to the die plate. The swage machine operates the swaging actuator to move the die plate over the fitting jacket of the pipe fitting in an outwardly axial direction away from the grab plate of the swage machine to facilitate conformally deforming the fitting jacket around the tubing of the pipe segment.

In another embodiment, a method of operating a swage machine includes loading a die to be used to conformally deform a fitting jacket of a pipe fitting around tubing of a pipe segment in a die plate of the swage machine such that the die opens away from a grab plate of the swage machine, loading a portion of a pipeline system including the pipe fitting into the swage machine such that a grab tab on the grab plate of the swage machine matingly interlocks with a grab notch on a grab ring of the pipe fitting to facilitate securing the swage machine to the pipe fitting, engaging the die loaded in the die plate of the swage machine with the portion of the pipeline system loaded in the swage machine, and operating a swaging actuator secured to the die plate of the swage machine to move the die plate over the fitting jacket of the pipe fitting in an outwardly axial direction away from the grab plate of the swage machine such that the die loaded in the die plate conformally deforms the fitting jacket around the tubing of the pipe segment to facilitate securing the pipe fitting to the pipe segment.

In another embodiment, a swage machine includes a grab plate, in which the grab plate includes a grab tab that matingly interlocks with a grab notch on a grab ring of a pipe fitting to be swaged by the swage machine to facilitate securing the swage machine to the pipe fitting, a die plate, one or more dies to be loaded in the die plate of the swage machine, and a swaging actuator including an actuator piston and an actuator cylinder. The actuator cylinder is secured to the grab plate of the swage machine and the actuator piston extends through the grab plate and is secured to the die plate of the swage machine to enable the swage machine to move the one or more dies loaded in the die plate over a fitting jacket of the pipe fitting such that the one or more dies conformally deform the fitting jacket around pipe segment tubing inserted in the pipe fitting to facilitate securing the pipe fitting to the pipe segment tubing.

DETAILED DESCRIPTION

Figure 1:
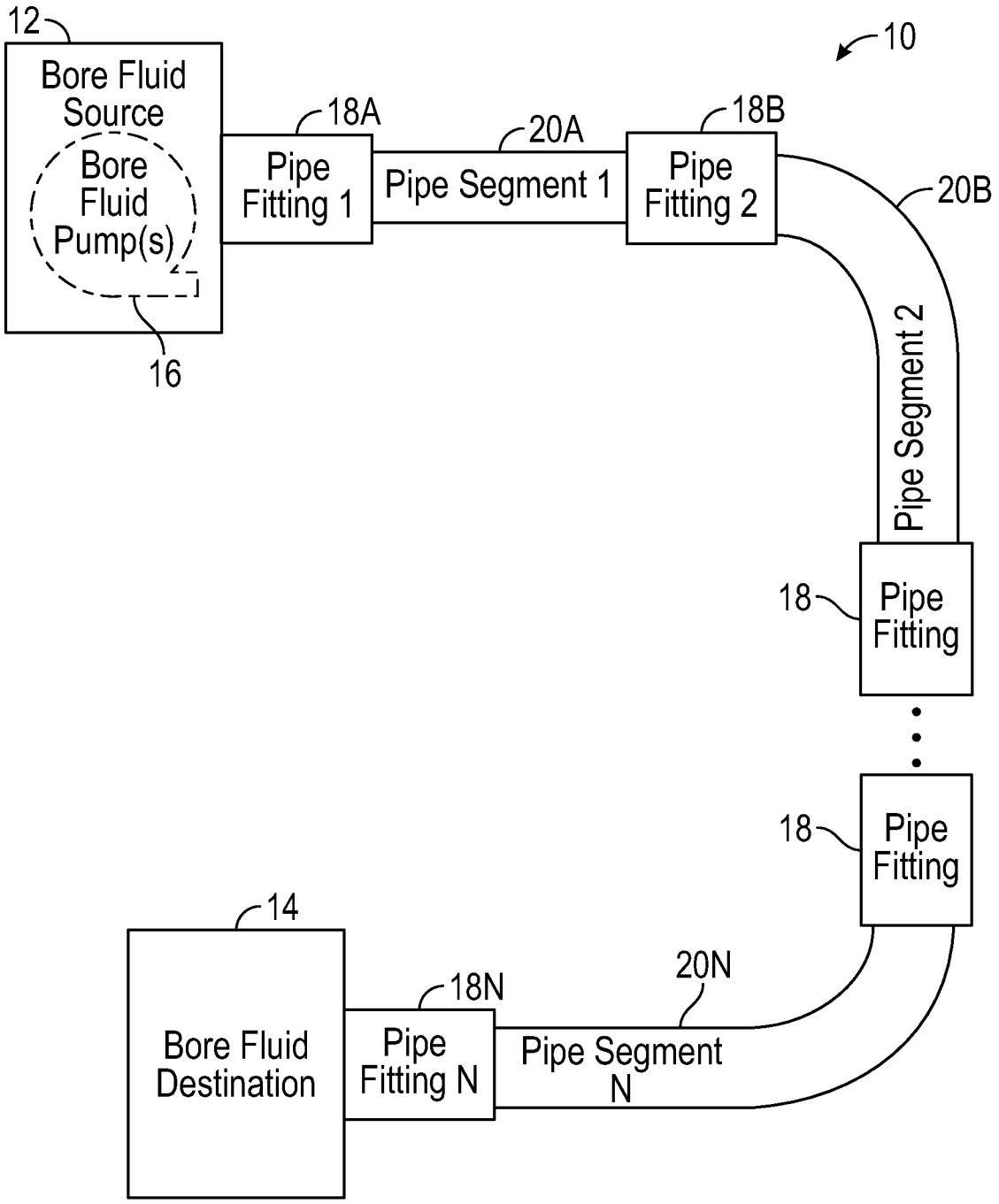
FIG. 1 is a block diagram of an example of a pipeline system including pipe segments and pipe fittings (e.g., connectors), in accordance with an embodiment of the present disclosure.

One or more specific embodiments of the present disclosure will be described below with reference to the figures. As used herein, the term "coupled" or "coupled to" may indicate establishing either a direct or indirect connection and, thus, is not limited to either unless expressly referenced as such. The term "set" may refer to one or more items. Wherever possible, like or identical reference numerals are used in the figures to identify common or the same features. The figures are not necessarily to scale. In particular, certain features and/or certain views of the figures may be shown exaggerated in scale for purposes of clarification.

The present disclosure generally relates to pipeline systems that may be implemented and/or operated to transport (e.g., convey) fluid, such as liquid and/or gas, from a fluid source to a fluid destination. Generally, a pipeline system may include pipe fittings (e.g., connectors), such as a midline pipe fitting and/or a pipe end fitting, and one or more pipe segments, which each includes tubing that defines (e.g., encloses) a corresponding pipe bore. More specifically, a pipe segment may generally be secured and sealed in one or more pipe fittings to facilitate fluidly coupling the pipe segment to another pipe segment, a fluid source, and/or a fluid destination. Merely as an illustrative non-limiting example, a pipeline system may include a first pipe end fitting secured to a first pipe segment to facilitate fluidly coupling the first pipe segment to the fluid source, a midline pipe fitting secured between the first pipe segment and a second pipe segment to facilitate fluidly coupling the first pipe segment to the second pipe segment, and a second pipe end fitting secured to the second pipe segment to facilitate fluidly coupling the second pipe segment to the fluid destination.

In any case, to enable fluid flow therethrough, a pipe fitting generally includes a fitting bore, which is defined (e.g., enclosed) by a fitting tube of the pipe fitting. Additionally, in some instances, the pipe fitting may be secured to a pipe segment at least in part by securing the tubing of the pipe segment around the fitting tube of the pipe fitting using swaging techniques. To facilitate securing a pipe segment thereto via swaging techniques, the pipe fitting may include one or more fitting jackets implemented circumferentially around its fitting tube. When implemented in this manner, the pipe fitting may be secured to the pipe fitting via swaging techniques at least in part by disposing (e.g., inserting) the tubing of the pipe segment in a tubing cavity of the pipe fitting, which is defined (e.g., enclosed) between a corresponding fitting jacket and the fitting tube, and conformally deforming the fitting jacket around the pipe segment tubing such that an inner surface of the corresponding fitting jacket and/or a corresponding outer surface of the fitting tube engage the pipe segment tubing.

To facilitate enabling the engagement between a pipe fitting and pipe segment tubing to secure the pipe fitting to a corresponding pipe segment, the pipe fitting may be implemented using a relatively rigid material. For example, a fitting jacket of the pipe fitting may be implemented using metal, such as carbon steel, stainless steel, duplex stainless steel, and/or super duplex stainless steel. However, at least in some instances, the amount of force sufficient to conformally deform a pipe fitting implemented using a relatively rigid material around the tubing of a pipe segment may potentially limit the efficiency with which the pipe fitting is secured to the pipe segment and, thus, potentially the deployment efficiency of a pipeline system in which the pipe fitting and the pipe segment are to be deployed.

Accordingly, to facilitate improving pipeline deployment efficiency, the present disclosure provide techniques for implementing and/or operating special-purpose deployment equipment—namely a swage machine—to facilitate securing a pipe fitting implemented using a relatively rigid material, such as metal, to the tubing of one or more pipe segments, which are deployed or are to be deployed in a pipeline system, using swaging techniques. As described above, swaging techniques may facilitate securing a pipe fitting to pipe segment tubing at least in part by conformally deforming a fitting jacket of the pipe fitting around a portion of the pipe segment tubing that is inserted into a tubing cavity of the pipe fitting, which is defined between the fitting jacket and a fitting tube of the pipe fitting. To facilitate swaging (e.g., conformally deforming) the pipe fitting, the swage machine may include a grab plate with a grab tab, which is implemented (e.g., sized and/or shaped) to matingly interlock with a grab notch on a grab ring of the pipe fitting, and a die plate in which one or more dies can be loaded (e.g., installed). In particular, due to its shape, a die loaded into the die plate of the swage machine may facilitate conformally deforming the pipe fitting around the pipe segment when the die passes (e.g., moves) over the pipe fitting in an axial direction.

To facilitate passing a die plate over a pipe fitting, a swage machine may additionally include one or more swaging actuators. In some embodiments, the one or more swaging actuators may include one or more hydraulic actuators and/or one or more pneumatic actuators. Thus, in such embodiments, a swaging actuator of the swage machine may include an actuator cylinder and an actuator piston (e.g., arm), which selectively extends out from the actuator cylinder based at least in part on the supply of fluid (e.g., liquid and/or gas) to the actuator cylinder and/or selectively retracts into the actuator cylinder based at least in part on the extraction of fluid from the actuator cylinder. In other words, in such embodiments, the swaging actuator may be operated to selectively extend and/or to selectively retract its actuator piston to facilitate passing the die plate of the swage machine and, thus, the one or more dies loaded therein over the pipe fitting such that the pipe fitting is conformally deformed around the pipe segment tubing that is inserted therein.

In particular, in some embodiments, a swage machine may be implemented and/or operated to push its die plate and, thus, one or more dies loaded therein over a pipe fitting in an inwardly axial direction toward its grab plate. To enable the die plate to be pushed toward the grab plate, in such embodiments, the swage machine may additionally include a support plate, which is coupled to the grab plate via one or more support members (e.g., a support rod and/or a machine housing of the swage machine) such that the die plate is positioned between the grab plate and the support plate. Additionally, in such embodiments, a swaging actuator of the swage machine may be secured to the support plate and the die plate, for example, such that its actuator cylinder is secured to the support plate and its actuator piston is secured to the die plate or vice versa. Furthermore, in such embodiments, a die may be loaded into the die plate such that it opens toward the grab plate, thereby enabling the swage machine to swage a pipe fitting secured to the grab plate at least in part by pushing the die plate over a fitting jacket of the pipe fitting in an inwardly axial direction toward the grab plate and, thus, away from the support plate via one or more forward (e.g., extending and/or pushing) strokes of its one or more swaging actuators.

To facilitate improving its deployment efficiency, in other embodiments, the weight of a swage machine may be reduced, for example, at least in part by obviating a support plate and/or one or more support members (e.g., support rods). Merely as an illustrative non-limiting example, in some such embodiments, a swage machine may be implemented to pull its die plate and, thus, one or more dies loaded therein over a pipe fitting in an inwardly axial direction toward its die plate. To enable the die plate to be pulled toward the grab plate, a swaging actuator of the swage machine may be secured to the grab plate and the die plate, for example, such that its actuator cylinder is secured to the grab plate and its actuator piston extends through the grab plate and is secured to the die plate or vice versa. Additionally, in such embodiments, a die may be loaded into the die plate such that it opens toward the grab plate, thereby enabling the swage machine to swage a pipe fitting secured to the grab plate at least in part by pulling the die plate over a fitting jacket of the pipe fitting in an inwardly axial direction toward the grab plate via one or more reverse (e.g., retracting and/or pulling) strokes of its one or more swaging actuators.

However, at least in some instances, swaging a fitting jacket of a pipe fitting in an inwardly axial direction may result in a raised portion forming in the fitting jacket, for example, at a location proximate to the grab ring of the pipe fitting. In fact, in some instances, an outer surface diameter of the raised portion formed in the fitting jacket may be greater than the outer surface diameter of other portions of the pipe fitting as well as the outer surface diameter of pipe segment tubing secured to the pipe fitting. As such, at least in some instances, swaging a fitting jacket of a pipe fitting in an inwardly axial direction may potentially limit the ability of the pipe fitting to be disposed in an external bore (e.g., during a pipe rehabilitation process), for example, due to the outer surface diameter of a raised portion formed in the fitting jacket being greater than an inner surface diameter of the external bore.

To facilitate reducing the outer surface diameter of a pipe fitting that results after swaging, in other embodiments, a swage machine may be implemented and/or operated to swage a fitting jacket of the pipe fitting in an outwardly axial direction at least in part by moving the die plate of the swage machine away from the grab plate of the swage machine. In particular, in some such embodiments, the swage machine may be implemented and/or operated to pull the die plate and, thus, one or more dies loaded therein over a pipe fitting in an outwardly axial direction away from the grab plate. To enable the die plate to be pulled away from the grab plate, in such embodiments, the swage machine may additionally include a support plate, which is coupled to the grab plate via one or more support members (e.g., a support rod and/or a machine housing of the swage machine) such that the die plate is positioned between the grab plate and the support plate. Additionally, in such embodiments, a swaging actuator of the swage machine may be secured to the grab plate and the die plate, for example, such that its actuator cylinder is secured to the die plate and its actuator piston is secured to the die plate or vice versa. Furthermore, in such embodiments, a die may be loaded into the die plate such that it is opens away from the grab plate, thereby enabling the swage machine to swage a pipe fitting secured to the grab plate at least in part by pulling the die plate over a fitting jacket of the pipe fitting in an outwardly axial direction away from the grab plate and, thus, toward the support plate in an outwardly axial direction via one or more reverse (e.g., retracting and/or pulling) strokes of its one or more swaging actuators.

However, actuation strength of a reverse (e.g., retracting and/or pulling) stroke of a swaging actuator is generally less than the actuation strength of a forward (e.g., extending and/or pushing) stroke of the swaging actuator. For example, in some instances, the actuation strength of the reverse stroke may be half the actuation strength of the forward stroke. In other words, to produce the same actuation strength, in such instances, a swaging actuator implemented in a reverse stroke (e.g., pulling) swage machine may be twice as large as a swaging actuator implemented in a forward stroke (e.g., pushing) swage machine.

As such, to facilitate increasing its actuation strength, in other embodiments, a swage machine may be implemented and/or operated to push its die plate and, thus, one or more dies loaded therein over a pipe fitting in an outwardly axial direction away from its grab plate. In particular, to enable pushing the die plate away from the grab plate, a swaging actuator of the swage machine may be secured to the die plate and the grab plate, for example, such that its actuator cylinder is secured to the grab plate and its actuator piston extends through the grab plate and is secured to the die plate or vice versa. Additionally, in such embodiments, a die may be loaded into the die plate such that it opens away from the grab plate, thereby enabling the swage machine to swage a pipe fitting secured to the grab plate at least in part by pushing the die plate over a fitting jacket of the pipe fitting in an outwardly axial direction away from the grab plate via one or more forward (e.g., extending and/or pushing) strokes of its one or more swaging actuators. In this manner, as will be described in more detail below, the present disclosure provides techniques for implementing and/or operating special-purpose deployment equipment—namely a swage machine—to facilitate securing a pipe fitting implemented using a relatively rigid material, such as metal, to the tubing of one or more pipe segments deployed or to be deployed in a pipeline system using swaging techniques, which, at least in some instances, may facilitate improving deployment efficiency of the pipeline system, for example, at least in part by obviating a manual swaging process.

To help illustrate, an example of a pipeline system 10 is shown in FIG. 1. As depicted, the pipeline system 10 is coupled between a bore fluid source 12 and a bore fluid destination 14. Merely as an illustrative non-limiting example, the bore fluid source 12 may be a production well and the bore fluid destination 14 may be a fluid storage tank. In other instances, the bore fluid source 12 may be a first (e.g., lease facility) storage tank and the bore fluid destination 14 may be a second (e.g., refinery) storage tank.

In any case, the pipeline system 10 may generally be implemented and/or operated to facilitate transporting (e.g., conveying) fluid, such as gas and/or liquid, from the bore fluid source 12 to the bore fluid destination 14. In fact, in some embodiments, the pipeline system 10 may be used in many applications, including without limitation, both onshore and offshore oil and gas applications. For example, in such embodiments, the pipeline system 10 may be used to transport one or more hydrocarbons, such as crude oil, petroleum, natural gas, or any combination thereof. Additionally or alternatively, the pipeline system 10 may be used to transport one or more other types of fluid, such as produced water, fresh water, fracturing fluid, flowback fluid, carbon dioxide, or any combination thereof.

To facilitate flowing fluid to the bore fluid destination 14, in some embodiments, the bore fluid source 12 may include one or more bore fluid pumps 16 that are implemented and/or operated to inject (e.g., pump and/or supply) fluid from the bore fluid source 12 into a bore of the pipeline system 10. However, it should be appreciated that the depicted example is merely intended to be illustrative and not limiting. In particular, in other embodiments, one or more bore fluid pumps 16 may not be implemented at the bore fluid source 12, for example, when fluid flow through the bore of the pipeline system 10 is produced by gravity. Additionally or alternatively, in other embodiments, one or more bore fluid pumps 16 may be implemented in the pipeline system 10 and/or at the bore fluid destination 14.

To facilitate transporting fluid from the bore fluid source 12 to the bore fluid destination 14, as in the depicted example, a pipeline system 10 may include one or more pipe fittings (e.g., connectors) 18 and one or more pipe segments 20. For example, the depicted pipeline system 10 includes a first pipe segment 20A, a second pipe segment 20B, and an Nth pipe segment 20N. Additionally, the depicted pipeline system 10 includes a first pipe (e.g., end) fitting 18A, which couples the bore fluid source 12 to the first pipe segment 20A, a second pipe (e.g., midline) fitting 18B, which couples the first pipe segment 20A to the second pipe segment 20B, and an Nth pipe (e.g., end) fitting 18N, which couples the Nth pipe segment 20N to the bore fluid destination 14.

However, it should again be appreciated that the depicted example is merely intended to be illustrative and not limiting. In particular, in other embodiments, a pipeline system 10 may include fewer (e.g., one) pipe segments 20. Additionally or alternatively, in other embodiments, a pipeline system 10 may include fewer (e.g., one or two) pipe fittings 18.

In any case, as described above, a pipe segment 20 generally includes tubing that may be used to convey (e.g., transfer and/or transport) water, gas, oil, and/or any other suitable type of fluid. The tubing of a pipe segment 20 may be made of any suitable type of material, such as plastic, metal, and/or a composite (e.g., fiber-reinforced composite) material. In fact, as will be described in more detail below, in some embodiments, the tubing of a pipe segment 20 may be implemented using multiple different layers. For example, the tubing of a pipe segment 20 may include a first high-density polyethylene (e.g., internal corrosion protection) layer, one or more reinforcement (e.g., steel strip) layers external to the first high-density polyethylene layer, and a second high-density polyethylene (e.g., external corrosion protection) layer external to the one or more reinforcement layers.

Additionally, as in the depicted example, one or more (e.g., second and/or Nth) pipe segments 20 in a pipeline system 10 may be curved. To facilitate implementing a curve in a pipe segment 20, in some embodiments, the pipe segment 20 may be flexible, for example, such that the pipe segment 20 is spoolable on a reel and/or in a coil (e.g., during transport and/or before deployment of the pipe segment 20). In other words, in some embodiments, one or more pipe segments 20 in the pipeline system 10 may be a flexible pipe, such as a bonded flexible pipe, an unbonded flexible pipe, a flexible composite pipe (FCP), a thermoplastic composite pipe (TCP), or a reinforced thermoplastic pipe (RTP). In fact, at least in some instances, increasing flexibility of a pipe segment 20 may facilitate improving deployment efficiency of a pipeline system 10, for example, by obviating a curved (e.g., elbow) pipe fitting 18 and/or enabling the pipe segment 20 to be transported to the pipeline system 10, deployed in the pipeline system 10, or both using a tighter spool.

To facilitate improving pipe flexibility, in some embodiments, the tubing of a pipe segment 20 that defines (e.g., encloses) its pipe bore may include one or more openings devoid of solid material. In fact, in some embodiments, an opening in the tubing of a pipe segment 20 may run (e.g., span) the length of the pipe segment 20 and, thus, define (e.g., enclose) a fluid conduit in the annulus of the tubing, which is separate from the pipe bore. In other words, in such embodiments, fluid may flow through a pipe segment 20 via its pipe bore, a fluid conduit implemented within its tubing annulus, or both.

Figure 2:
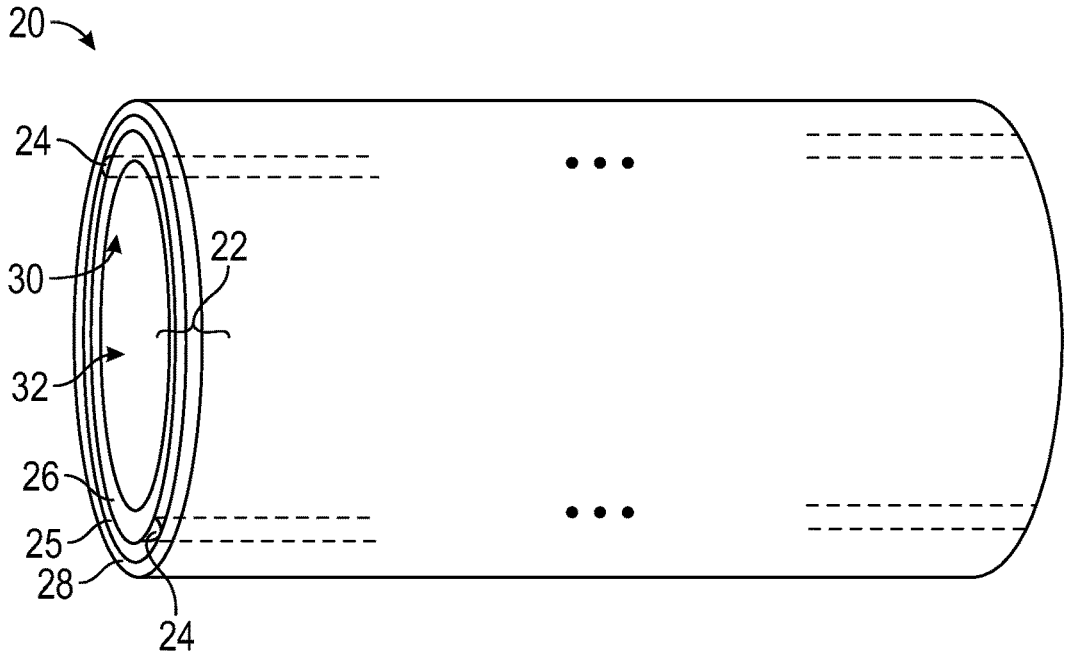
FIG. 2 is a side view of an example of a pipe segment of FIG. 1 that includes a pipe bore defined by its tubing as well as fluid conduits implemented within an annulus of its tubing, in accordance with an embodiment of the present disclosure.

To help illustrate, an example of a pipe segment 20, which includes tubing 22 with fluid conduits 24 implemented in a tubing annulus 25, is shown in FIG. 2. As depicted, the pipe segment tubing 22 is implemented with multiple layers including an inner (e.g., innermost) layer 26 and an outer (e.g., outermost) layer 28. In some embodiments, the inner layer 26 and/or the outer layer 28 of the pipe segment tubing 22 may be implemented using composite material and/or plastic, such as high-density polyethylene (HDPE) and/or raised temperature polyethylene (PE-RT). Although a number of particular layers are depicted, it should be understood that the techniques described in the present disclosure may be broadly applicable to composite pipe body structures including two or more layers, for example, as distinguished from a rubber or plastic single-layer hose subject to vulcanization. In any case, as depicted, an inner surface 30 of the inner layer 26 defines (e.g., encloses) a pipe bore 32 through which fluid can flow, for example, to facilitate transporting fluid from a bore fluid source 12 to a bore fluid destination 14.

Additionally, as depicted, the annulus 25 of the pipe segment tubing 22 is implemented between its inner layer 26 and its outer layer 28. As will be described in more detail below, the tubing annulus 25 may include one or more intermediate (e.g., reinforcement) layers of the pipe segment tubing 22. Furthermore, as depicted, fluid conduits 24 running along the length of the pipe segment 20 are defined (e.g., enclosed) in the tubing annulus 25. As described above, a fluid conduit 24 in the tubing annulus 25 may be devoid of solid material. As such, pipe segment tubing 22 that includes one or more fluid conduits 24 therein may include less solid material and, thus, exert less resistance to flexure, for example, compared to solid pipe segment tubing 22 and/or pipe segment tubing 22 that does not include fluid conduits 24 implemented therein. Moreover, to facilitate further improving pipe flexibility, in some embodiments, one or more layers in the tubing 22 of a pipe segment 20 may be unbonded from one or more other layers in the tubing 22 and, thus, the pipe segment 20 may be an unbonded pipe.

However, it should be appreciated that the depicted example is merely intended to be illustrative and not limiting. In particular, in other embodiments, pipe segment tubing 22 may include fewer (e.g., one) or more (e.g., three, four, or more) fluid conduits 24 defined in its tubing annulus 25. Additionally, in other embodiments, a fluid conduit 24 defined in a tubing annulus 25 of a pipe segment 20 run non-parallel to the pipe bore 32 of the pipe segment 20, for example, such that the fluid conduit 24 is skewed relative to the axial (e.g., longitudinal) extent of the pipe bore 32.

Figure 3:
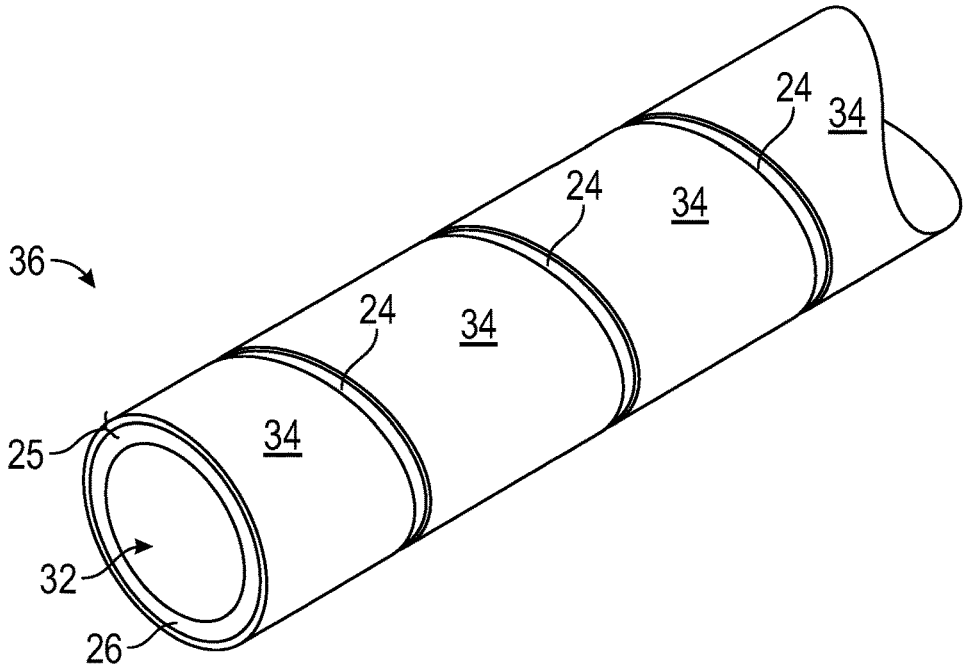
FIG. 3 is a perspective view of an example of a portion of the pipe segment of FIG. 2 with a helically shaped fluid conduit implemented within the annulus of its tubing, in accordance with an embodiment of the present disclosure.

To help illustrate, an example of a portion 36 of a pipe segment 20, which includes an inner layer 26 and an intermediate (e.g., reinforcement) layer 34 included in a tubing annulus 25 of its pipe segment tubing 22, is shown in FIG. 3. In some embodiments, one or more intermediate layers 34 of the pipe segment tubing 22 may be implemented using composite material and/or metal, such as carbon steel, stainless steel, duplex stainless steel, super duplex stainless steel, or any combination thereof. In other words, at least in some such embodiments, an intermediate layer 34 of the pipe segment tubing 22 may be implemented using electrically conductive, which, at least in some instances, may enable communication of electrical (e.g., control and/or sensor) signals via the intermediate layer 34.

In any case, as depicted, the intermediate layer 34 is helically disposed (e.g., wound and/or wrapped) on the inner layer 26 such that gaps (e.g., openings) are left between adjacent windings to define a fluid conduit 24. In other words, in some embodiments, the intermediate layer 34 may be implemented at least in part by winding a solid strip of material around the inner layer 26 at a non-zero lay angle (e.g., fifty-four degrees) relative to the axial (e.g., longitudinal) extent of the pipe bore 32. In any case, as depicted, the resulting fluid conduit 24 runs helically along the pipe segment 20, for example, such that the fluid conduit 24 is skewed fifty-four degrees relative to the axial extent of the pipe bore 32.

In some embodiments, an outer layer 28 may be disposed directly over the depicted intermediate layer 34 and, thus, cover and/or define (e.g., enclose) the depicted fluid conduit 24. However, in other embodiments, the tubing annulus 25 of pipe segment tubing 22 may include multiple (e.g., two, three, four, or more) intermediate layers 34. In other words, in such embodiments, one or more other intermediate layers 34 may be disposed over the depicted intermediate layer 34. In fact, in some such embodiments, the one or more other intermediate layers 34 may also each be helically disposed such that gaps are left between adjacent windings to implement one or more corresponding fluid conduits 24 in the pipe segment tubing 22.

For example, a first other intermediate layer 34 may be helically disposed on the depicted intermediate layer 34 using the same non-zero lay angle as the depicted intermediate layer 34 to cover (e.g., define and/or enclose) the depicted fluid conduit 24 and to implement another fluid conduit 24 in the first other intermediate layer 34. Additionally, a second other intermediate layer 34 may be helically disposed on the first other intermediate layer 34 using another non-zero lay angle, which is the inverse of the non-zero lay angle of the depicted intermediate layer 34, to implement another fluid conduit 24 in the second other intermediate layer 34. Furthermore, a third other intermediate layer 34 may be helically disposed on the second other intermediate layer 34 using the same non-zero lay angle as the second other intermediate layer 34 to cover the other fluid conduit 24 in the second other intermediate layer 34 and to implement another fluid conduit 24 in the third other intermediate layer 34. In some embodiments, an outer layer 28 may be disposed over the third other intermediate layer 34 and, thus, cover (e.g., define and/or enclose) the other fluid conduit 24 in the third other intermediate layer 34. In any case, to facilitate flowing fluid from a bore fluid source 12 to a bore fluid destination 14, as described above, one or more pipe fittings 18, such as a midline pipe fitting 18 and/or a pipe end fitting 18, may be secured to a pipe segment 20.

Figure 4:
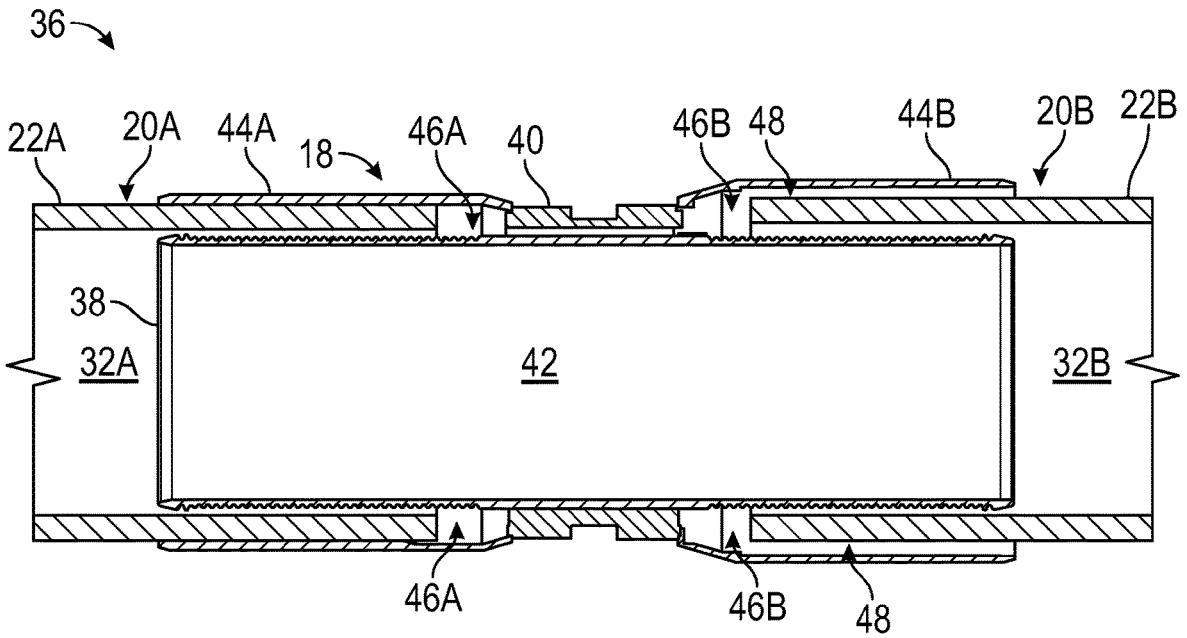
FIG. 4 is an axial cross-section profile of an example of a portion of the pipeline system of FIG. 1 that includes a pipe fitting and pipe segments, in accordance with an embodiment of the present disclosure.

To help illustrate, an example cross-section of a portion 36 of a pipeline system 10, which includes a first pipe segment 20A, a second pipe segment 20B, and a pipe fitting 18, is shown in FIG. 4. As depicted, the pipe fitting 18 includes a fitting tube 38 and a grab ring 40, which is implemented circumferentially around the fitting tube 38. In particular, as depicted, the fitting tube 38 defines (e.g., encloses) a fitting bore 42, which is fluidly coupled to a first pipe bore 32A of the first pipe segment 20A and a second pipe bore 32B of the second pipe segment 20B.

In other words, the pipe fitting 18 in FIG. 4 may be a midline pipe fitting 18. However, it should be appreciated that the depicted example is merely intended to be illustrative and not limiting. In particular, in other embodiments, the techniques described in the present disclosure may additionally or alternatively be used with other types of pipe fittings 18, such as a pipe end fitting 18.

In any case, as depicted, the pipe fitting 18 includes fitting jackets 44—namely a first fitting jacket 44A and a second fitting jacket 44B—implemented circumferentially around the fitting tube 38. In particular, as depicted, first tubing 22A of the first pipe segment 20A is disposed in a first tubing cavity 46A of the pipe fitting 18, which is defined between the first fitting jacket 44A and the fitting tube 38. Similarly, second tubing 22B of the second pipe segment 20B is disposed in a second tubing cavity 46B of the pipe fitting 18, which is defined between the second fitting jacket 44B and the fitting tube 38.

However, as depicted, open space 48 is present between the second tubing 22B of the second pipe segment 20B and the pipe fitting 18 whereas minimal open space is present between the first tubing 22A of the first pipe segment 20A and the pipe fitting 18. In other words, the pipe fitting 18 may exert more resistance to tubing movement in the first tubing cavity 46A and, thus, facilitate securing the pipe fitting 18 to the first pipe segment 20A. On the other hand, the pipe fitting 18 may exert less resistance to tubing movement in the second tubing cavity 46B, which, at least in some instances, may enable the second tubing 22B of the second pipe segment 20B to move relatively freely into and/or out from the second tubing cavity 46B of the pipe fitting 18.

As such, to facilitate securing the pipe fitting 18 to the second pipe segment 20B, the second fitting jacket 44B may be swaged such that it is conformally deformed around the second tubing 22B of the second pipe segment 20B. In particular, the second fitting jacket 44B may be conformally deformed to consume at least a portion (e.g., majority) of the open space 48, for example, to enable an inner surface of the second fitting jacket 44B to engage with an outer surface of the second pipe segment tubing 22B and/or an outer surface of the fitting tube 38 to engage with an inner surface of the second pipe segment tubing 22B. In fact, in some embodiments, special-purpose deployment equipment—namely a swage machine—may be implemented and/or operated to facilitate securing a pipe fitting 18 to one or more pipe segments 20, for example, due to the pipe fitting 18 being implementing at least in part using a relatively rigid material, such as metal.

Figure 5:
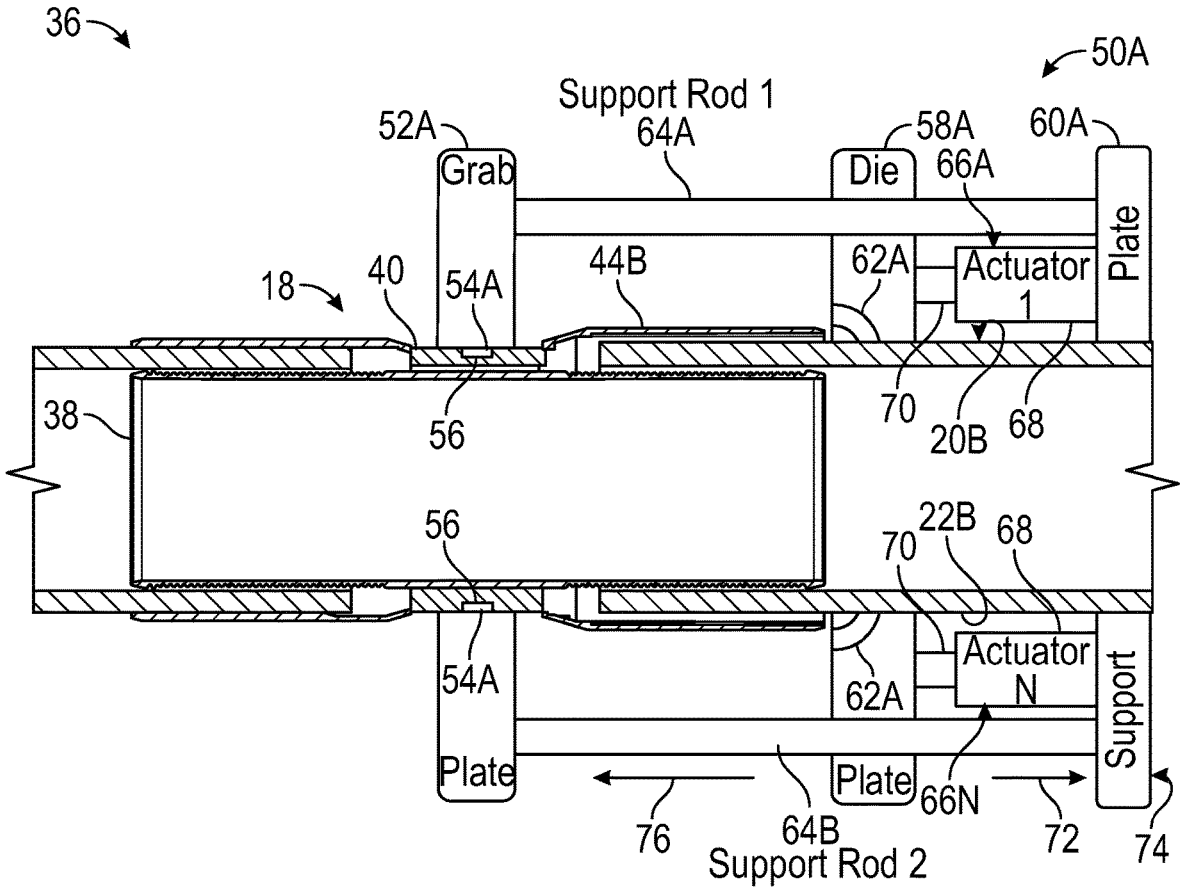
FIG. 5 is an axial cross-section profile of an example of a swage machine and the portion of the pipeline system of FIG. 4, in accordance with an embodiment of the present disclosure.

To help illustrate, an example of a swage machine 50A secured to the portion 36 of the pipeline system 10 is shown in FIG. 5. In particular, as depicted, the swage machine 50A is secured to the grab ring 40 of the pipe fitting 18. To facilitate securing the grab ring 40 thereto, as depicted, the swage machine 50A includes a grab plate 52A with a grab tab 54A, which is implemented (e.g., sized and/or shaped) to matingly interlock with a grab notch 56 on the grab ring 40.

Additionally, as depicted, the swage machine 50A includes a die plate 58A and a support plate 60A. In particular, as depicted, one or more dies (e.g., die segments) 62A may be loaded (e.g., installed) in the die plate 58A. Furthermore, as in the depicted example, in some embodiments, one or more support rods 64 may be secured to the grab plate 52A and the support plate 60A. In particular, in the depicted example, the swage machine 50A includes a first support rod 64A and a second support rod 64B, which each extends through the die plate 58A and is secured to the grab plate 52A and the support plate 60A.

Moreover, as in the depicted example, a swage machine 50 may include one or more swaging actuators 66. In particular, in the depicted example, the swage machine 50A includes a first swaging actuator 66A and an Nth swaging actuator 66N. In some embodiments, one or more swaging actuators 66 of a swage machine 50 may be a hydraulic actuator and/or a pneumatic actuator.

In any case, as depicted, each swaging actuator 66 of the swage machine 50A includes an actuator cylinder 68 and an actuator piston 70, which is implemented and/or operated to selectively extend out from the actuator cylinder 68 based at least in part on the supply of fluid (e.g., liquid and/or gas) to the actuator cylinder 68 and/or to selectively retract into the actuator cylinder 68 based at least in part on the extraction of fluid from the actuator cylinder 68. In particular, as in the depicted example, in some embodiments, the actuator piston 70 of each swaging actuator 66 may be secured to the die plate 58A. Additionally, as in the depicted example, in some embodiments, the actuator cylinder 68 of each swaging actuator 66 may be secured to an inner surface 72 of the support plate 60A.

However, it should be appreciated that the depicted example is merely intended to be illustrative and not limiting. In particular, in other embodiments, a swage machine 50 may include fewer than two (e.g., one) swaging actuator 66 or more than two (e.g., three, four, or more) swaging actuators 66. Additionally or alternatively, in other embodiments, an actuator cylinder 68 of a swaging actuator 66 in a swage machine 50 may be secured to an outer surface 74 of a support plate 50 in the swage machine 50. Furthermore, in other embodiments, a swaging actuator 66 of a swage machine 50 may be secured to a die plate 58 and a support plate 60 of the swage machine 50 such that its actuator cylinder 68 is secured to the die plate 58 and its actuator piston 70 is secured to the support plate 60. Moreover, as will be described in more detail below, in other embodiments, a swage machine 50 may include another type of support member, such as a machine housing of the swage machine 50, secured to its support plate 60 and its grab plate 52 in addition to or as an alternative to one or more support rods 64.

In any case, as depicted in FIG. 5, a die 62A is loaded (e.g., installed) in the die plate 58A of the swage machine 50A such that it opens toward the grab plate 52A of the swage machine 50A and, thus, away from the support plate 60A. As such, the die 62A may facilitate conformally deforming and, thus, swaging the second fitting jacket 44B around the second tubing 22B of the second pipe segment 20B when it is moved over the second fitting jacket 44B in an inwardly axial direction 76 toward the grab plate 52A and, thus, away from the support plate 60A. In other words, to facilitate swaging the second fitting jacket 44B, one or more swaging actuators 66 of the swage machine 50A may be operated to push the die plate 58A and, thus, one or more dies 62A loaded therein inwardly over the second fitting jacket 44B via one or more forward (e.g., extending and/or pushing) strokes. In this manner, a swage machine 50 may be implemented to facilitate swaging a pipe fitting 18 in an inwardly axial direction 76 via one or more actuator forward strokes.

Figure 6:
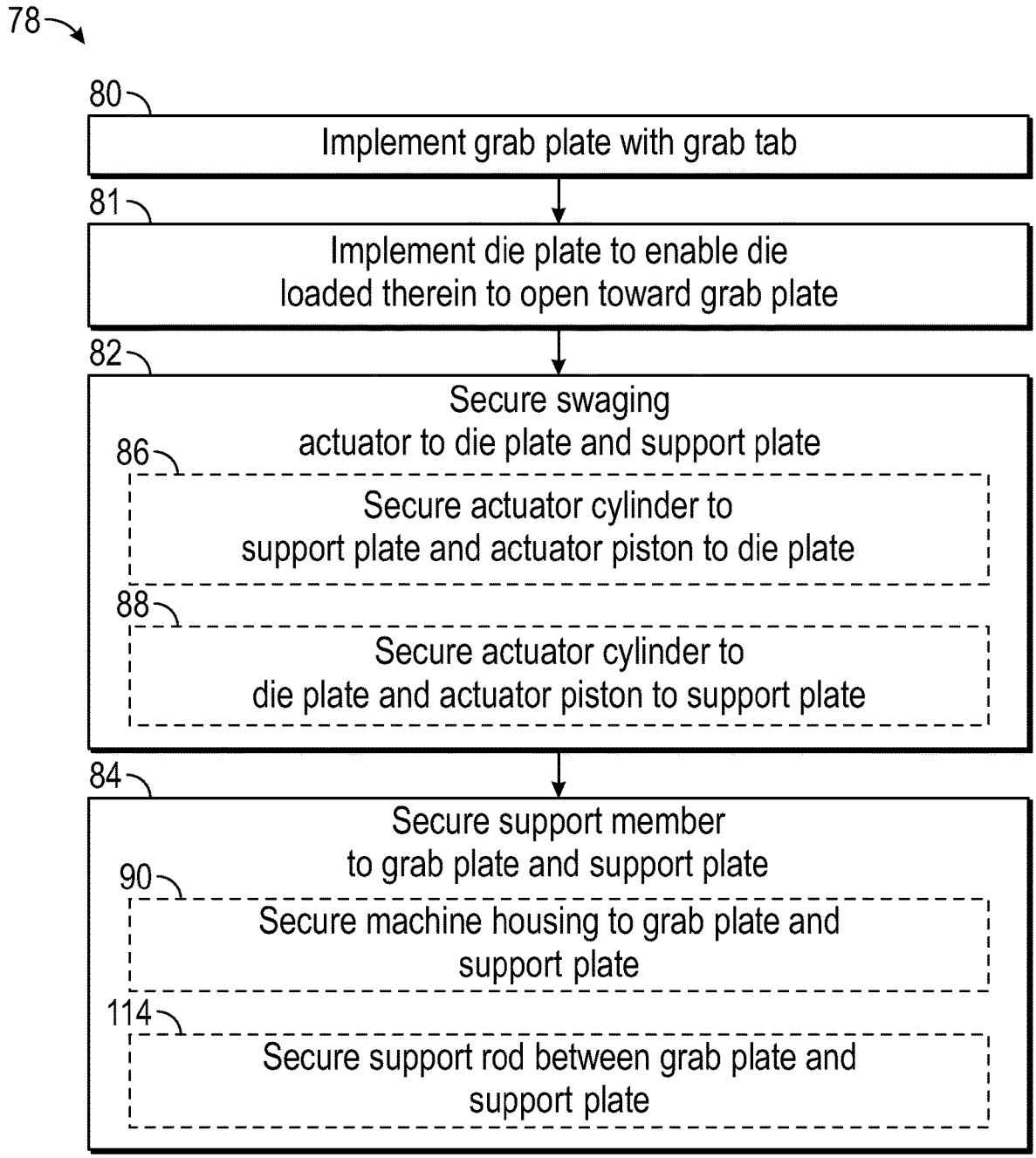
FIG. 6 is a flow diagram of an example of a process for implementing the swage machine of FIG. 5, in accordance with an embodiment of the present disclosure.

To help further illustrate, an example of a process 78 for implementing an inward direction-forward stroke swage machine 50 is described in FIG. 6. Generally, the process 78 includes implementing a grab plate with a grab tab (process block 80) and implementing a die plate to enable a die loaded therein to open toward the grab plate (process block 81). Additionally, the process 78 generally includes securing a swaging actuator to the die plate and a support plate (process block 82) and securing a support member to the grab plate and the support plate (process block 84).

Although described in a specific order, which corresponds with an embodiment of the present disclosure, it should be appreciated that the example process 78 is merely intended to be illustrative and non-limiting. In particular, in other embodiments, a process 78 for implementing a swage machine 50 may include one or more additional process blocks and/or omit one or more of the depicted process blocks. Additionally or alternatively, in other embodiments, one or more of the depicted process blocks may be performed in a different order, for example, such that the support member is secured before the swaging actuator 66.

In any case, as described above, the (e.g., inward direction-forward stroke) swage machine 50A of FIG. 5 includes a grab plate 52A with a grab tab 54A, which is implemented (e.g., shaped and/or sized) to matingly interlock with a grab notch 56 on the grab ring 40 of a pipe fitting 18 that is to be swaged by the swage machine 50A. As such, implementing the swage machine 50A may include implementing a grab plate 52A with a grab tab 54A (process block 80). In some embodiments, the grab plate 52A may be implemented at least in part using metal, such as carbon steel, stainless steel, duplex stainless steel, and/or super duplex stainless steel.

Additionally, as described above, the swage machine 50A of FIG. 5 includes a die plate 58A, which is implemented to enable one or more dies 62A to be loaded (e.g., installed) therein. In particular, as described above, the one or more dies 62A may be loaded into the die plate 58A such that the one or more dies 62A open toward the grab plate 52A of the swage machine 50A and, thus, away from the support plate 60A. As such, implementing the swage machine 50A may include implementing a die plate 58A to enable one or more dies 62A to be loaded into the die plate 58A such that they open toward the grab plate 52A (process block 81). In some embodiments, the die plate 58A of the swage machine 50A may be implemented at least in part using metal, such as carbon steel, stainless steel, duplex stainless steel, and/or super duplex stainless steel.

Furthermore, as described above, the swage machine 50A of FIG. 5 includes one or more swaging actuators 66. In particular, as described above, the one or more swaging actuators 66 may be secured to a die plate 58A and a support plate 60A of the swage machine 50A. As such, implementing the swage machine 50A may include securing one or more swaging actuators 66 to the die plate 58A and the support plate 60A of the swage machine 50A (process block 82). In some embodiments, the support plate 60A of the swage machine 50A may be implemented at least in part using metal, such as carbon steel, stainless steel, duplex stainless steel, and/or super duplex stainless steel.

In any case, as described above, a swaging actuator 66 of the swage machine 50A may include an actuator cylinder 68 and an actuator piston 70. In particular, as described above, in some embodiments, the actuator cylinder 68 of the swaging actuator 66 may be secured to the support plate 60A of the swage machine 50A and the actuator piston 70 of the swaging actuator 66 may be secured to the die plate 58A of the swage machine 50A. Thus, in such embodiments, securing a swaging actuator 66 to the die plate 58A and the support plate 60A may include securing the actuator cylinder 68 of the swaging actuator 66 to the support plate 60A and securing the actuator piston 70 of the swaging actuator 66 to the die plate 58A (process block 86). However, in other embodiments, the actuator cylinder 68 of a swaging actuator 66 may be secured to the die plate 58A and the actuator piston 70 of the swaging actuator 66 may be secured to the support plate 60A. Thus, in such embodiments, securing a swaging actuator 66 to the die plate 58A and the support plate 60A may include securing the actuator cylinder 68 of the swaging actuator 66 to the die plate 58A and securing the actuator piston 70 of the swaging actuator 66 to the support plate 60A (process block 88).

Moreover, as described above, the swage machine 50A of FIG. 5 may include one or more support members secured to its grab plate 52A and its support plate 60A. As such, implementing the swage machine 50A may include securing one or more support members to the grab plate 52A and the support plate 60A of the swage machine 50A (process block 84). In particular, as described above, in some embodiments, a support member of the swage machine 50A may be a machine housing of the swage machine 50A. Thus, in such embodiments, securing the support member to the grab plate 52A and the support plate 60A may include securing a machine housing of the swage machine 50A to the grab plate 52A and the support plate 60A (process block 90). In particular, in some such embodiments, the machine housing of the swage machine 50A may be implemented at least in part using metal, such as carbon steel, stainless steel, duplex stainless steel, and/or super duplex stainless steel.

Figure 7:
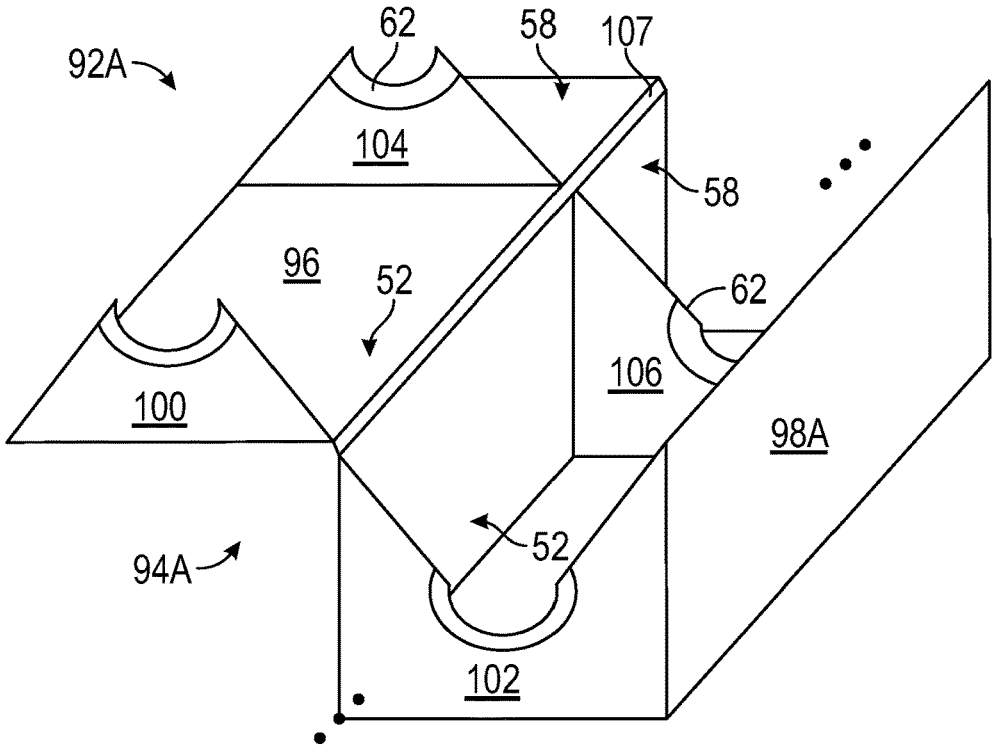
FIG. 7 is a perspective view of an example of a portion of a swage machine that is implemented and/or operated to selectively transition between an opened state and a closed state, in accordance with an embodiment of the present disclosure.

To help further illustrate, an example of a portion 92A of a swage machine 50, which includes a machine housing 94A, is shown in FIG. 7. In particular, as depicted, the machine housing 94A includes a housing lid 96 and a housing body 98A. Additionally, as depicted, the grab plate 52 of the swage machine 50 includes a lid portion 100 and a body portion 102. Similarly, as depicted, the die plate 58 of the swage machine 50 includes a lid portion 104 and a body portion 106.

Moreover, as depicted, the housing lid 96 is rotatably coupled to the housing body 98A via a hinge 107, thereby enabling the swage machine 50 to be selectively transitioned between an opened state in which the housing lid 96 is opened from the housing body 98A and a closed state in which the housing lid 96 is closed onto the housing body 98A. In some embodiments, the swage machine 50 may be transitioned from its closed state to its opened state to enable one or more dies 62 to be loaded into the die plate 58. Additionally, as will be described in more detail below, the swage machine 50 may be transitioned from its closed state to its opened state to enable a portion of a pipeline system 10 including at least a pipe fitting 18 and a pipe segment 20 to be loaded (e.g., laid and/or inserted) into the swage machine 50. After the portion of the pipeline system 10 has been loaded therein, the swage machine 50 may then be transitioned from its opened position to its closed position to facilitate engaging the one or more dies 62 loaded into the die plate 58 with the pipeline system 10 and, thus, swaging the pipe fitting 18 around the tubing 22 of the pipe segment 20.

However, it should be appreciated that the depicted example is merely intended to be illustrative and not limiting. In particular, as described above, in some embodiments, a swage machine 50 may additionally include one or more support rods 64, which are secured to its grab plate 52 and its support plate 60 such that the one or more support rods 64 extend through the die plate 58 of the swage machine 50 to enable the die plate 58 to slide within the machine housing 94. Moreover, in other embodiments, the machine housing 94 of a swage machine 50 may be implemented with a different shape, for example, such that the machine housing 94 does not fully enclose the swage machine 50 to facilitate loading a portion of pipeline system 10 to be swaged by the swage machine 50 into the swage machine 50.

Figure 8:
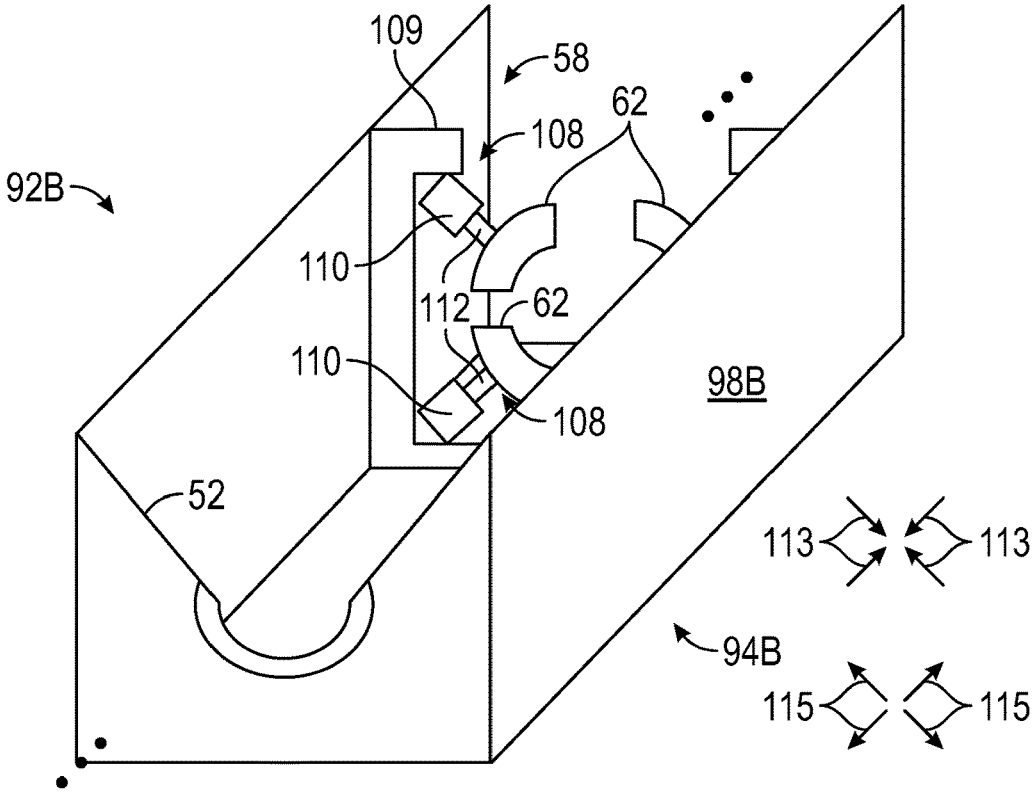
FIG. 8 is a perspective view of another example of a swage machine that is implemented and/or operated to selectively control an inner surface diameter of its die, in accordance with an embodiment of the present disclosure.

To help illustrate, another example of a portion 92B of a swage machine 50, which includes a machine housing 94B, is shown in FIG. 8. In particular, as depicted, the machine housing 94B includes a housing body 98B. In some embodiments, the housing body 98B of FIG. 8 may generally match the housing body 98A of FIG. 7.

However, as depicted, the machine housing 94B of FIG. 8 does not include a housing lid 96. To facilitate selectively engaging one or more dies 62 with a portion of a pipeline system 10 loaded into the swage machine 50, as depicted, die actuators 108 are secured between a plate rim 109 of the die plate 58 and the one or more dies 62. In some embodiments, a die actuator 108 of the swage machine 50 may be a hydraulic actuator and/or a pneumatic actuator.

In any case, as depicted, each die actuator 108 of the swage machine 50 includes an actuator cylinder 110 and an actuator piston 112. In particular, as depicted, the actuator cylinder 110 of each die actuator 108 is secured to the plate rim 109 and the actuator piston 112 of each die actuator 108 is secured to a corresponding die 62. As such, a die actuator 108 in the swage machine 50 may be operated to extend its actuator piston 112 out from its actuator cylinder 110 in an inwardly radial direction 113 to facilitate engaging the one or more dies 62 with the portion of a pipeline system 10 loaded into the swage machine 50. On the other hand, the die actuator 108 may be operated to retract its actuator piston 112 into its actuator cylinder 110 in an outwardly radial direction 115 to facilitate disengaging the one or more dies 62 from the portion of the pipeline system 10.

However, it should be appreciated that the depicted example is merely intended to be illustrative and not limiting. In particular, in other embodiments, a swage machine 50 may include fewer than four die 62 and die actuator 108 pairs or more than four die 62 and die actuator 108 pairs. Furthermore, as described above, in some embodiments, a swage machine 50 may additionally include one or more support rods 64, which are secured to its grab plate 52 and its support plate 60 such that the one or more support rods 64 extend through the die plate 58 of the swage machine 50 to enable the die plate 58 to slide within the machine housing 94.

In any case, returning to the process 78 of FIG. 6, as described above, in some embodiments, the one or more support members of the swage machine 50A may include one or more support rods 64. Thus, in such embodiments, securing the support member to the grab plate 52A and the support plate 60A may include securing a support rod 64 to the grab plate 52A and the support plate 60A, for example, such that the support rod 64 extends through the die plate 58A of the swage machine 50A (process block 114). In particular, in some such embodiments, the support rod 64 of the swage machine 50A may be implemented at least in part using metal, such as carbon steel, stainless steel, duplex stainless steel, and/or super duplex stainless steel. By implementing in this manner, a swage machine 50 may be operated to facilitate securing a pipe fitting 18 to the tubing 22 of one or more pipe segments 20 at least in part by swaging the pipe fitting 18 in an inwardly axial direction 76 via one or more actuator forward (e.g., extending and/or pushing) strokes.

Figure 9:
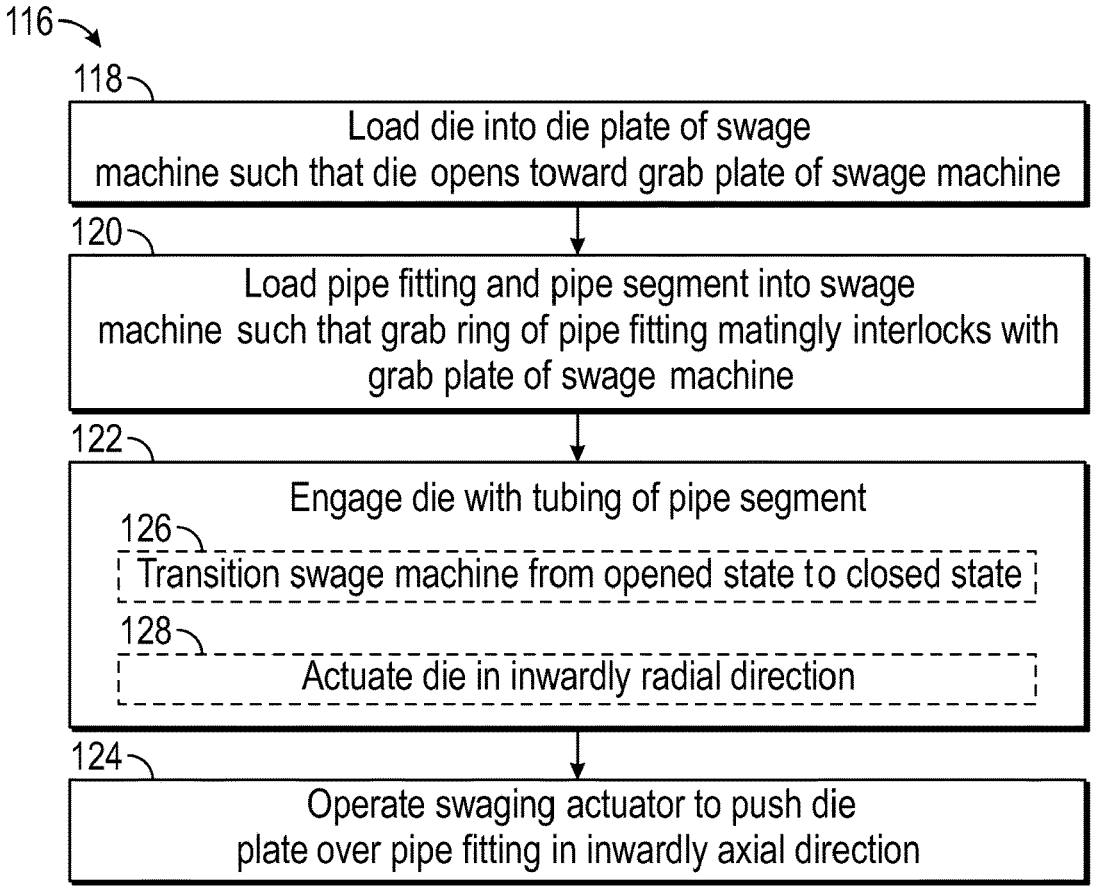
FIG. 9 is a flow diagram of an example of a process for operating the swage machine of FIG. 5, in accordance with an embodiment of the present disclosure.

To help further illustrate, an example of a process 116 for operating an inward direction-forward stroke swage machine 50 is described in FIG. 9. Generally, the process 116 includes loading a die into a die plate of a swage machine such that the die opens toward a grab plate of the swage machine (process block 118) and loading a pipe fitting and a pipe segment into the swage machine such that a grab ring of the pipe fitting matingly interlocks with the grab plate of the swage machine (process block 120). Additionally, the process 116 generally includes engaging the die with tubing of the pipe segment (process block 122) and operating a swaging actuator to push the die plate over the pipe fitting in an inwardly axial direction (process block 124).

Although described in a specific order, which corresponds with an embodiment of the present disclosure, it should be appreciated that the example process 116 is merely intended to be illustrative and non-limiting. In particular, in other embodiments, a process 116 for operating an inward direction-forward stroke swage machine 50 may include one or more additional process blocks and/or omit one or more of the depicted process blocks. Additionally or alternatively, in other embodiments, one or more of the depicted process blocks may be performed in a different order, for example, such that the pipe fitting 18 and the pipe segment 20 are loaded into the swage machine 50 before the die 62 is loaded into the die plate 58.

In any case, as described above, one or more dies (e.g., die segments) 62A may be loaded (e.g., installed) in the die plate 58A of the (e.g., inward direction-forward stroke) swage machine 50A of FIG. 5. In particular, as described above, the die plate 58A may be implemented to enable the one or more dies 62A to be loaded therein such that such that they open towards the grab plate 52A of the swage machine 50A. As such, operating the swage machine 50A may include loading one or more dies 62A into its die plate 58A such that the one or more dies 62A open toward its grab plate 52A (process block 118). In some embodiments, the one or more dies 62A may be secured in the die plate 58A via one or more fasteners, such as a C-clamp.

Additionally, as described above, the swage machine 50A of FIG. 5 includes a grab plate 52A with a grab tab 54A, which is implemented (e.g., sized and/or shaped) to matingly interlock with a grab notch 56 on a grab ring 40 of a pipe fitting 18 to be swaged by the swage machine 50A. Furthermore, as described above, a pipe fitting 18 may be secured to a pipe segment 20 at least in part by operating the swage machine 50A to conformally deform a fitting jacket 44 of the pipe fitting 18 around the tubing 22 of the pipe segment 20. As such, operating the swage machine 50A may include loading a pipe fitting 18 and a pipe segment 20 to be secured thereto into the swage machine 50A such that the grab notch 56 on the grab ring 40 of the pipe fitting 18 matingly interlocks with the grab tab 54A on the grab plate 52A of the swage machine 50A (process block 120).

To facilitate swaging the pipe fitting 18, the swage machine 50A may then be operated to engage the one or more dies 62A loaded in its die plate 58A with the tubing 22 of the pipe segment 20 (process block 122). As described above, in some embodiments, a die 62 of a swage machine 50 may be engaged with a portion of a pipeline system 10 that is loaded into the swage machine 50 at least in part by transitioning the swage machine 50 from its opened state in which its housing lid 96 is opened from its housing body 98 to its closed state in which its housing lid 96 is closed onto its housing body 98 (process block 126). Additionally or alternatively, as described above, a die 62 of a swage machine 50 may be engaged with a portion of a pipeline system 10 that is loaded into the swage machine 50 at least in part by operating a die actuator 108 secured to the die 62 to actuate the die 62 in an inwardly radial direction 113 (process block 128).

Moreover, as described above, one or more swaging actuators 66 of the swage machine 50A may then be operated to push the die plate 58A over the pipe fitting 18 in an inwardly axial direction 76 toward the grab plate 52A and, thus, away from the support plate 60A via one or more forward (e.g., extending and/or pushing) stroke (process block 124). In particular, as described above, a swaging actuator 66 of the swage machine 50A may be secured between the support plate 60A and to the die plate 58A of the swage machine 50A, for example, such that its actuator cylinder 68 is secured to the support plate 60A and its actuator piston 70 is secured to the die plate 58A or vice versa. As such, to facilitate pushing the die plate 58A over the pipe fitting 18, fluid may be supplied to the actuator cylinder 68 of the swaging actuator 66 to cause the actuator piston 70 of the swaging actuator 66 to extend out farther from the actuator cylinder 68. In this manner, a swage machine 50 may be operated to facilitate securing a pipe fitting 18 to the tubing 22 of a pipe segment 20 at least in part by swaging the pipe fitting 18 in an inwardly axial direction 76 via a forward (e.g., extending and/or pushing) stroke of one or more swaging actuators 66.

However, to facilitate improving its deployment efficiency, in other embodiments, a swage machine 50 may be implemented with a reduced weight. For example, in some such embodiments, the weight of a swage machine 50 may be reduced at least in part by obviating a support plate 60 and/or one or more support members (e.g., support rods 64). In particular, to facilitate obviating a support plate 60, the swage machine 50 may be implemented with a different configuration as compared to the (e.g., inward direction-forward stroke) swage machine 50A of FIG. 5.

Figure 10:
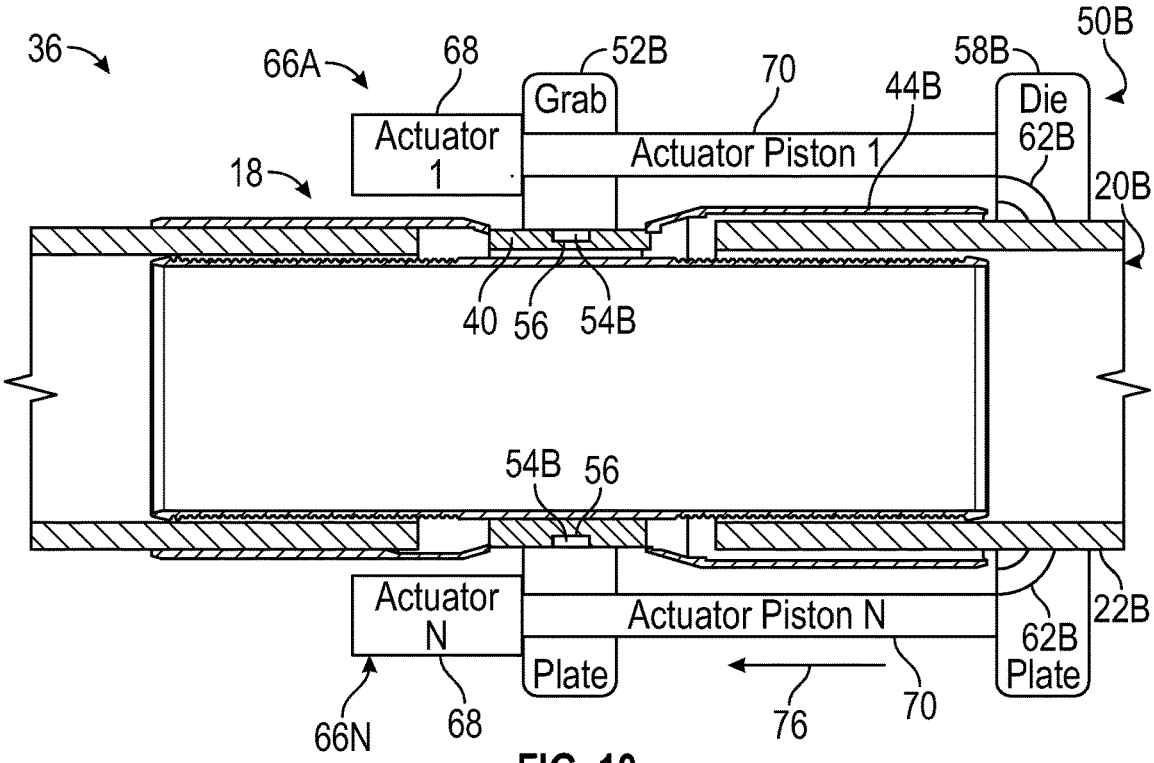
FIG. 10 is an axial cross-section view of another example of a swage machine and the portion of the pipeline system of FIG. 4, in accordance with an embodiment of the present disclosure.

To help illustrate, another example of a swage machine 50B secured to the portion 36 of the pipeline system 10 is shown in FIG. 10. In particular, as depicted, the swage machine 50B is secured to the grab ring 40 of the pipe fitting 18. To facilitate securing the grab ring 40 thereto, as depicted, the swage machine 50B includes a grab plate 52B with a grab tab 54B, which is implemented (e.g., sized and/or shaped) to matingly interlock with a grab notch 56 on the grab ring 40. As such, in some embodiments, the grab tab 54B of the swage machine 50B in FIG. 10 may generally match the grab tab 54A of the swage machine 50A in FIG. 5.

In any case, as depicted in FIG. 10, the swage machine 50B additionally includes a die plate 58B. In particular, as depicted, one or more dies (e.g., die segments) 62B may be loaded (e.g., installed) in the die plate 58B. In some embodiments, the one or more dies 62B of FIG. 10 may generally match the one or more dies 62A of FIG. 5.

Moreover, in the depicted example, the swage machine 50B includes a first swaging actuator 66A and an Nth swaging actuator 66N. As described above, in some embodiments, one or more swaging actuators 66 of a swage machine 50 may be a hydraulic actuator and/or a pneumatic actuator. In any case, as depicted, the one or more swaging actuators 66 each include an actuator cylinder 68 and an actuator piston 70, which is implemented and/or operated to selectively extend out from the actuator cylinder 68 based at least in part on the supply of fluid (e.g., liquid and/or gas) to the actuator cylinder 68 and/or to selectively retract into the actuator cylinder 68 based at least in part on the extraction of fluid from the actuator cylinder 68. In particular, as depicted, in some embodiments, the actuator cylinder 68 of each swaging actuator 66 may be secured to the grab plate 52B and the actuator piston 70 of each swaging actuator 66 may extend through the grab plate 52B and be secured to the die plate 58B.

Moreover, as depicted, a die 62B is loaded (e.g., installed) in the die plate 58B of the swage machine 50B such that it opens toward the grab plate 52B of the swage machine 50B. As such, the die 62B may facilitate conformally deforming and, thus, swaging the second fitting jacket 44B around the second tubing 22B of the second pipe segment 20B when moved over the second fitting jacket 44B in an inwardly axial direction 76 toward the grab plate 52B. In other words, to facilitate swaging the second fitting jacket 44B, one or more swaging actuators 66 of the swage machine 50B may be operated to pull the die plate 58B and, thus, one or more dies 62B loaded therein inwardly over the second fitting jacket 44B via one or more reverse (e.g., retracting and/or pulling) stroke. In this manner, a swage machine 50 may be implemented to facilitate swaging a pipe fitting 18 in an inwardly axial direction 76 via one or more actuator reverse strokes.

However, it should be appreciated that the depicted example is merely intended to be illustrative and not limiting. In particular, in other embodiments, a swage machine 50 may include fewer than two (e.g., one) swaging actuators 66 or more than two (e.g., three, four, or more) swaging actuators 66. Furthermore, in some embodiments, a swage machine 50 may additionally include one or more support members, such as a machine housing 94 and/or a support rod 64. Moreover, in other embodiments, a swaging actuator 66 of a swage machine 50 may be secured to a die plate 58 and a grab plate 52 of the swage machine 50 such that its actuator cylinder 68 is secured to the die plate 58 and its actuator piston 70 is secured to a grab plate 52.

Figure 11:
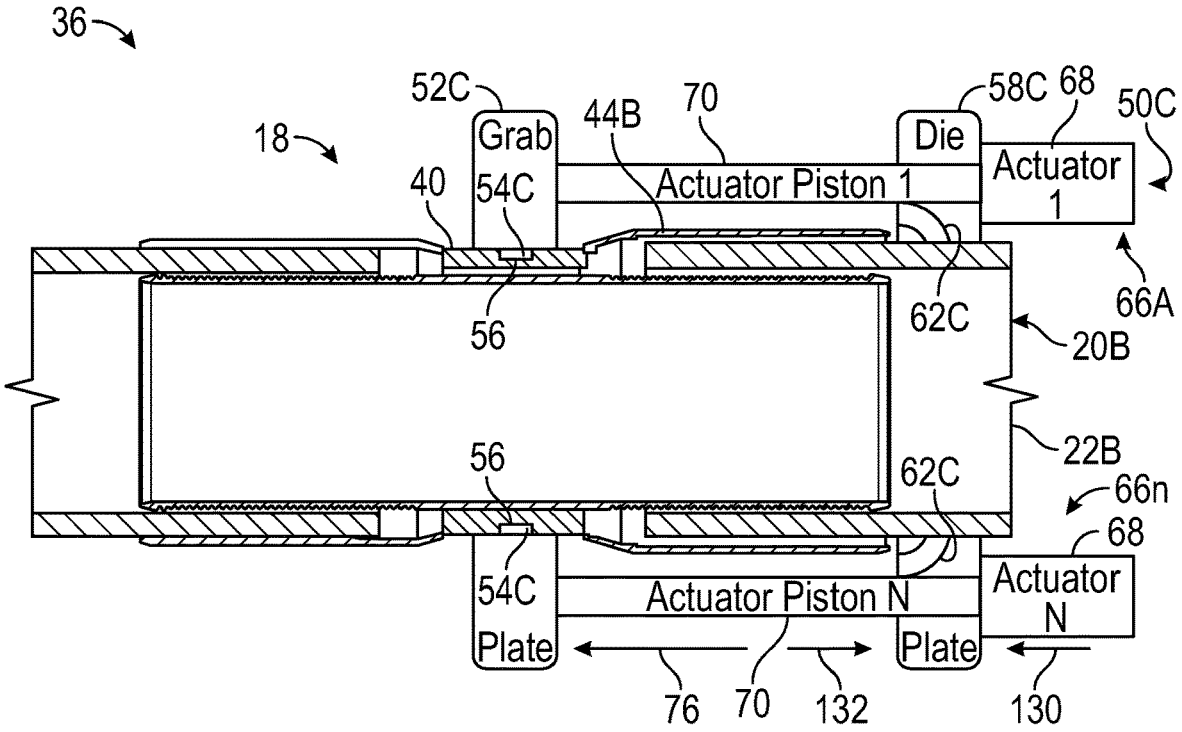
FIG. 11 is an axial cross-section view of another example of a swage machine and the portion of the pipeline system of FIG. 4, in accordance with an embodiment of the present disclosure.

To help illustrate, another example of a swage machine 50C secured to the portion 36 of the pipeline system 10 is shown in FIG. 11. In particular, as depicted, the swage machine 50C is secured to the grab ring 40 of the pipe fitting 18. To facilitate securing the grab ring 40 thereto, as depicted, the swage machine 50C includes a grab plate 52C with a grab tab 54C, which is implemented (e.g., sized and/or shaped) to matingly interlock with a grab notch 56 on the grab ring 40. As such, in some embodiments, the grab tab 54C of the swage machine 50C in FIG. 11 may generally match the grab tab 54A of the swage machine 50A in FIG. 5.

In any case, as depicted in FIG. 11, the swage machine 50C additionally includes a die plate 58C. In particular, as depicted, one or more dies (e.g., die segments) 62C may be loaded (e.g., installed) in the die plate 58C. In some embodiments, the one or more dies 62C of FIG. 11 may generally match the one or more dies 62A of FIG. 5.

Moreover, in the depicted example, the swage machine 50C includes a first swaging actuator 66A and an Nth swaging actuator 66N. As described above, in some embodiments, one or more swaging actuators 66 of a swage machine 50 may be a hydraulic actuator and/or a pneumatic actuator. In any case, as depicted, the one or more swaging actuators 66 each include an actuator cylinder 68 and an actuator piston 70, which is implemented and/or operated to selectively extend out from the actuator cylinder 68 based at least in part on the supply of fluid (e.g., liquid and/or gas) to the actuator cylinder 68 and/or to selectively retract into the actuator cylinder 68 based at least in part on the extraction of fluid from the actuator cylinder 68.

In particular, as depicted, the actuator piston 70 of each swaging actuator 66 in the swage machine 50C extends through the die plate 58C and is secured to the grab plate 52C, for example, instead of being secured to the die plate 58C. Additionally, as depicted, the actuator cylinder 68 of each swaging actuator 66 in the swage machine 50C is secured to the die plate 58C, for example, instead of to an additional support plate 60. In particular, as in the depicted example, in some embodiments, the actuator cylinders 68 may be secured to an outer surface 130 of the die plate 58C.

However, it should be appreciated that the depicted example is merely intended to be illustrative and not limiting. In particular, in other embodiments, a swage machine 50 may include fewer than two (e.g., one) swaging actuators 66 or more than two (e.g., three, four, or more) swaging actuators 66. Additionally or alternatively, in other embodiments, an actuator cylinder 68 of a swaging actuator 66 in a swage machine 50 may be secured to an inner surface 132 of a die plate 58 in the swage machine 50. Moreover, in other embodiments, a swage machine 50 may additionally include one or more support members, such as a machine housing 94 and/or a support rod 64.

In any case, as depicted in FIG. 11, a die 62C is loaded (e.g., installed) in the die plate 52C of the swage machine 50C such that it opens toward the grab plate 52C of the swage machine 50C. As such, the die 62C may facilitate conformally deforming and, thus, swaging the second fitting jacket 44B around the second tubing 22B of the second pipe segment 20B when moved over the second fitting jacket 44B in an inwardly axial direction 76 toward the grab plate 52C. In other words, to facilitate swaging the second fitting jacket 44B, one or more swaging actuators 66 of the swage machine 50C may be operated to pull the grab plate 52C toward the die plate 58C such that the one or more dies 62C loaded into the die plate 58C move over the second fitting jacket 44B of the pipe fitting 18 that is secured to the grab plate 52C via one or more reverse (e.g., retracting and/or pulling) stroke. In this manner, a swage machine 50 may be implemented to facilitate swaging a pipe fitting 18 in an inwardly axial direction 76 via one or more actuator reverse strokes.

Figure 12:
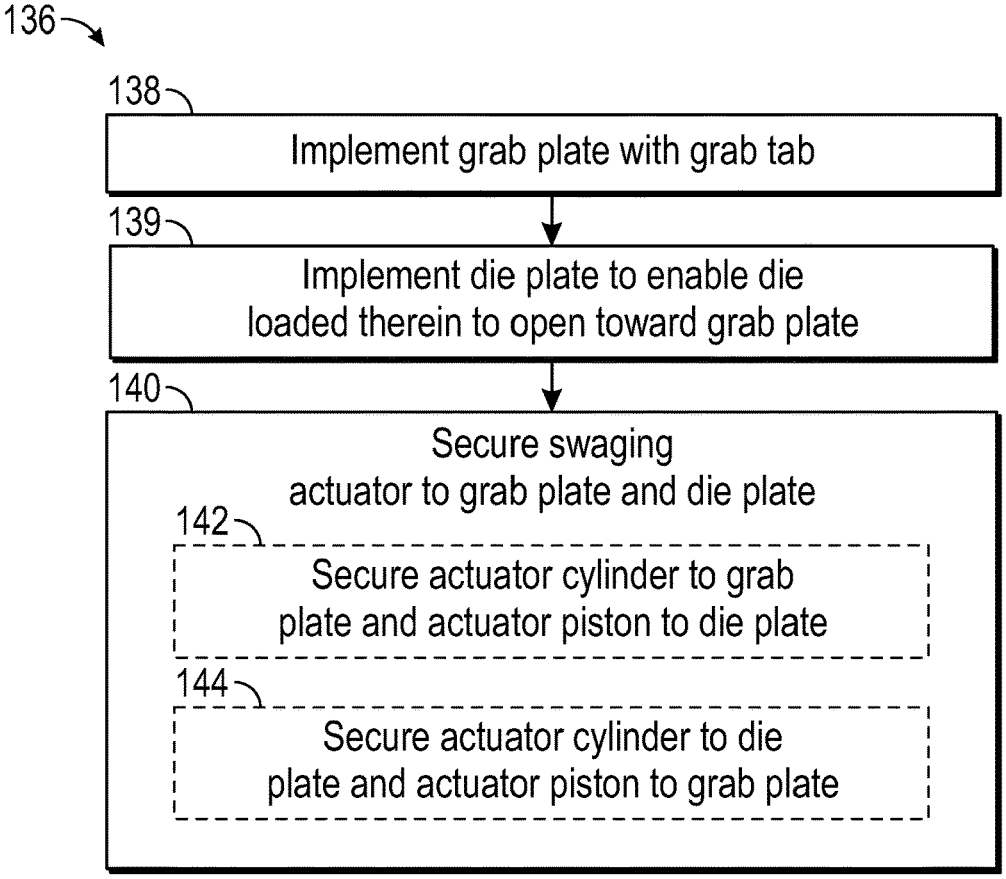
FIG. 12 is an example of a process for implementing the swage machine of FIG. 10 or the swage machine of FIG. 11, in accordance with an embodiment of the present disclosure.

To help further illustrate, another example of a process 136 for implementing a (e.g., inward direction-reverse stroke) swage machine 50 is described in FIG. 12. Generally, the process 136 includes implementing a grab plate with a grab tab (process block 138) and implementing a die plate to enable a die loaded therein to open toward the grab plate (process block 139). Additionally, the process 136 includes securing a swaging actuator to the grab plate and the die plate (process block 140)

Although described in a specific order, which corresponds with an embodiment of the present disclosure, it should be appreciated that the example process 136 is merely intended to be illustrative and non-limiting. In particular, in other embodiments, a process 136 for implementing a swage machine 50 may include one or more additional process blocks and/or omit one or more of the depicted process blocks. Additionally or alternatively, in other embodiments, one or more of the depicted process blocks may be performed in a different order, for example, such that the die plate 58 is implemented before the grab plate 52.

In any case, as described above, the (e.g., inward direction-reverse stroke) swage machine 50B of FIG. 10 includes a grab plate 52B with a grab tab 54B, which is implemented (e.g., shaped and/or sized) to matingly interlock with a grab notch 56 on the grab ring 40 of a pipe fitting 18 to be swaged by the swage machine 50B. As such, implementing the swage machine 50B may include implementing a grab plate 52B with a grab tab 54B (process block 138). In some embodiments, the grab plate 52B may be implemented at least in part using metal, such as carbon steel, stainless steel, duplex stainless steel, and/or super duplex stainless steel.

Additionally, as described above, the swage machine 50B of FIG. 10 includes a die plate 58B, which is implemented to enable one or more dies 62B to be loaded (e.g., installed) therein. In particular, as described above, the one or more dies 62B may be loaded into the die plate 58B such that the one or more dies 62B open toward the grab plate 52B of the swage machine 50B. As such, implementing the swage machine 50B may include implementing a die plate 58B to enable one or more dies 62B to be loaded into the die plate 58B such that they open toward the grab plate 52B (process block 139). In some embodiments, the die plate 58B of the swage machine 50B may be implemented at least in part using metal, such as carbon steel, stainless steel, duplex stainless steel, and/or super duplex stainless steel.

Furthermore, as described above, the swage machine 50B of FIG. 10 includes one or more swaging actuators 66. In particular, as described above, the one or more swaging actuators 66 of the swage machine 50B may be secured to the grab plate 52B and the die plate 58B of the swage machine 50B. As such, implementing the swage machine 50B may include securing one or more swaging actuators 66 to the die plate 58B and the grab plate 52B of the swage machine 50B (process block 140).

Moreover, as described above, a swaging actuator 66 of a swage machine 50 may include an actuator cylinder 68 and an actuator piston 70. In particular, as depicted in FIG. 10, in some embodiments, a swaging actuator 66 of the swage machine 50B may be secured such that its actuator cylinder 68 is secured to the grab plate 52B and its actuator piston 70 extends through the grab plate 52B and is secured to the die plate 58B. Thus, in such embodiments, securing a swaging actuator 66 to the die plate 58B and the grab plate 52B may include securing the actuator cylinder 68 of the swaging actuator 66 to the grab plate 52B and securing the actuator piston 70 of the swaging actuator 66 to the die plate 58B, for example, such the actuator piston 70 extends through the grab plate 52B (process block 142).

However, in other embodiments, as depicted in the swage machine 50C of FIG. 11, a swaging actuator 66 of the swage machine 50C may be secured such that its actuator cylinder 68 is secured to a die plate 58C of the swage machine 50C and its actuator piston 70 extends through the die plate 58C and is secured to the grab plate 52C of the swage machine 50C. Thus, in such embodiments, securing a swaging actuator 66 to the die plate 58C and the grab plate 52C may include securing the actuator cylinder 68 of the swaging actuator 66 to the die plate 58C and securing the actuator piston 70 of the swaging actuator 66 to the grab plate 52C (process block 144). By implementing in this manner, a swage machine 50 may be operated to facilitate securing a pipe fitting 18 to the tubing 22 of one or more pipe segments 20 at least in part by swaging the pipe fitting 18 in an inwardly axial direction 76 via one or more actuator reverse (e.g., retracting and/or pulling) strokes.

Figure 13:
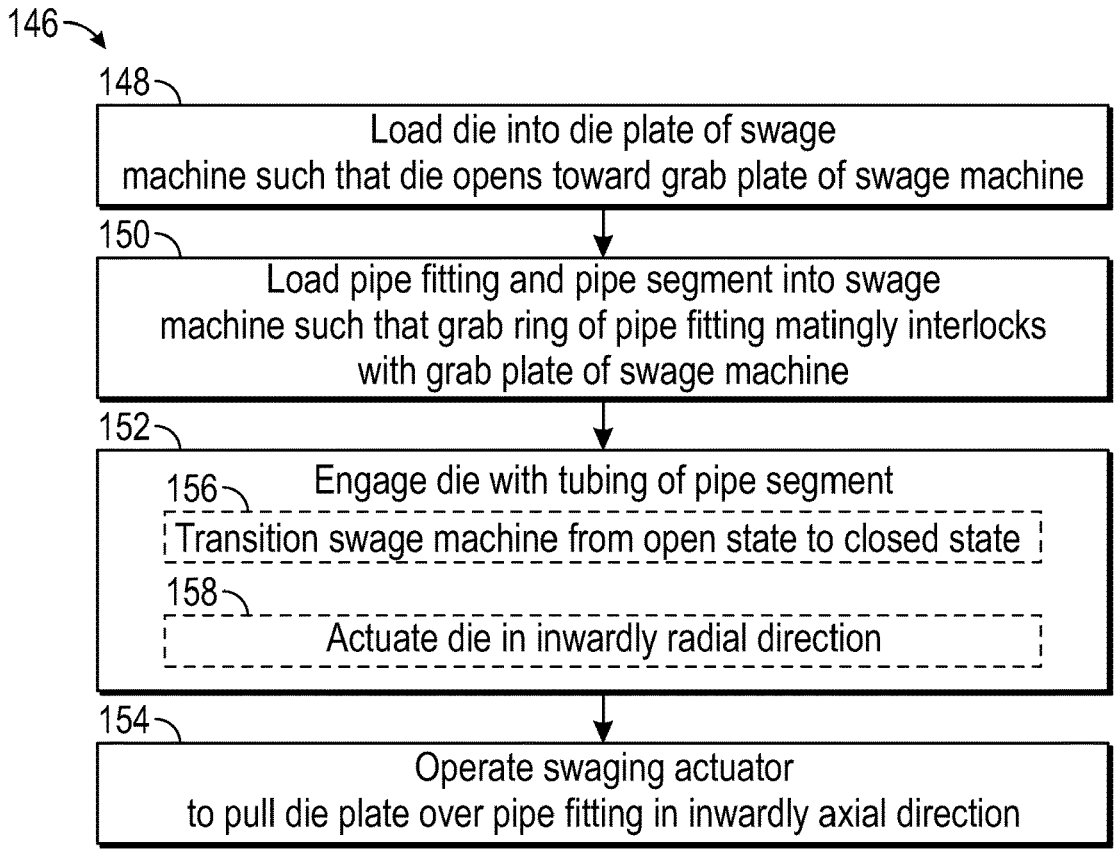
FIG. 13 is an example of a process for operating the swage machine of FIG. 10 or the swage machine of FIG. 11, in accordance with an embodiment of the present disclosure.

To help further illustrate, an example of a process 146 for operating an inward direction-reverse stroke swage machine 50 is described in FIG. 13. Generally, the process 146 includes loading a die into a die plate of a swage machine such that the die opens toward a grab plate of the swage machine (process block 148) and loading a pipe fitting and a pipe segment into the swage machine such that a grab ring of the pipe fitting matingly interlocks with the grab plate of the swage machine (process block 150). Additionally, the process 146 generally includes engaging the die with tubing of the pipe segment (process block 152) and operating a swaging actuator to pull the die plate over the pipe fitting in an inwardly axial direction (process block 154).

Although described in a specific order, which corresponds with an embodiment of the present disclosure, it should be appreciated that the example process 146 is merely intended to be illustrative and non-limiting. In particular, in other embodiments, a process 146 for operating an inward direction-reverse stroke swage machine 50 may include one or more additional process blocks and/or omit one or more of the depicted process blocks. Additionally or alternatively, in other embodiments, one or more of the depicted process blocks may be performed in a different order, for example, such that the pipe fitting 18 and the pipe segment 20 are loaded into the swage machine 50 before the die 62 is loaded into the die plate 58.

In any case, as described above, one or more dies (e.g., die segments) 62B may be loaded (e.g., installed) in the die plate 58B of the (e.g., inward direction-reverse stroke) swage machine 50B of FIG. 10. In particular, as described above, the die plate 58B may be implemented to enable the one or more dies 62B to be loaded therein such that the one or more dies 62B open toward the grab plate 52B of the swage machine 50B. As such, operating the swage machine 50B may include loading one or more dies 62B into its die plate 58B such that the one or more dies 62B open toward its grab plate 52B (process block 148). In some embodiments, the one or more dies 62B may be secured in the die plate 58B via one or more fasteners, such as a C-clamp.

Additionally, as described above, the swage machine 50B of FIG. 10 includes a grab plate 52B with a grab tab 54B, which is implemented (e.g., sized and/or shaped) to matingly interlock with a grab notch 56 on a grab ring 40 of a pipe fitting 18 to be swaged by the swage machine 50B. Furthermore, as described above, a pipe fitting 18 may be secured to a pipe segment 20 at least in part by operating the swage machine 50B to conformally deform a fitting jacket 44 of the pipe fitting 18 around the tubing 22 of the pipe segment 20. As such, operating the swage machine 50B may include loading a pipe fitting 18 and a pipe segment 20 to be secured thereto into the swage machine 50B such that the grab notch 56 on the grab ring 40 of the pipe fitting 18 matingly interlocks with the grab tab 54B on the grab plate 52B of the swage machine 50B (process block 150).

To facilitate swaging the pipe fitting 18, the swage machine 50B may then be operated to engage one or more of its dies 62B with the tubing 22 of the pipe segment 20 (process block 152). As described above, in some embodiments, a die 62 of a swage machine 50 may be engaged with a portion of a pipeline system 10 that is loaded into the swage machine 50 at least in part by transitioning the swage machine 50 from its opened state in which its housing lid 96 is opened from its housing body 98 to its closed state in which its housing lid 96 is closed onto its housing body 98 (process block 156). Additionally or alternatively, as described above, a die 62 of a swage machine 50 may be engaged with a portion of a pipeline system 10 that is loaded into the swage machine 50 at least in part by operating a die actuator 108 secured to the die 62 to actuate the die 62 in an inwardly radial direction 113 (process block 158).

Moreover, as described above, one or more swaging actuators 66 of the swage machine 50B may then be operated to pull the die plate 58B over the pipe fitting 18 in an inwardly axial direction 76 toward the grab plate 52B via one or more reverse (e.g., retracting and/or pulling) strokes. In particular, as described above, in some embodiments, a swaging actuator 66 of the swage machine 50B may be secured to the grab plate 52B and the die plate 58B of the swage machine 50, for example, such that its actuator cylinder 68 is secured to the grab plate 52B and its actuator piston 70 extends through the grab plate 52B and is secured to the die plate 58B or vice versa. As such, to facilitate pulling the die plate 52B over the pipe fitting 18, fluid may be extracted from the actuator cylinder 68 of the swaging actuator 66 to cause the actuator piston 70 of the swaging actuator 66 to retract farther into the actuator cylinder 68. In this manner, a swage machine 50 may be operated to facilitate securing a pipe fitting 18 to the tubing 22 of a pipe segment 20 at least in part by swaging the pipe fitting 18 in an inwardly axial direction 76 via a reverse (e.g., retracting and/or pulling) stroke of one or more swaging actuators 66.

However, at least in some instances, swaging a fitting jacket 44 of a pipe fitting 18 in an inwardly axial direction 76 may result in a raised portion forming in the fitting jacket 44, for example, at a location proximate to the grab ring 40 of the pipe fitting 18. In fact, in some instances, an outer surface diameter of the raised portion formed in the fitting jacket 44 may be greater than the outer surface diameter of other portions of the pipe fitting 18 as well as the outer surface diameter of pipe segment tubing 22 secured to the pipe fitting 18. As such, at least in some instances, swaging a fitting jacket 44 of a pipe fitting 18 in an inwardly axial direction 76 may potentially limit the ability of the pipe fitting 18 to be disposed in an external bore (e.g., during a pipeline rehabilitation process), for example, due to the outer surface diameter of a raiser portion formed in the fitting jacket 44 being greater than an inner surface diameter of the external bore. As such, to facilitate reducing the outer surface diameter of a pipe fitting 18 that results after swaging, in other embodiments, a swage machine 50 may be implemented and/or operated to swage a fitting jacket 44 of the pipe fitting 18 in an opposite (e.g., reverse) direction—namely an outwardly axial direction.

Figure 14:
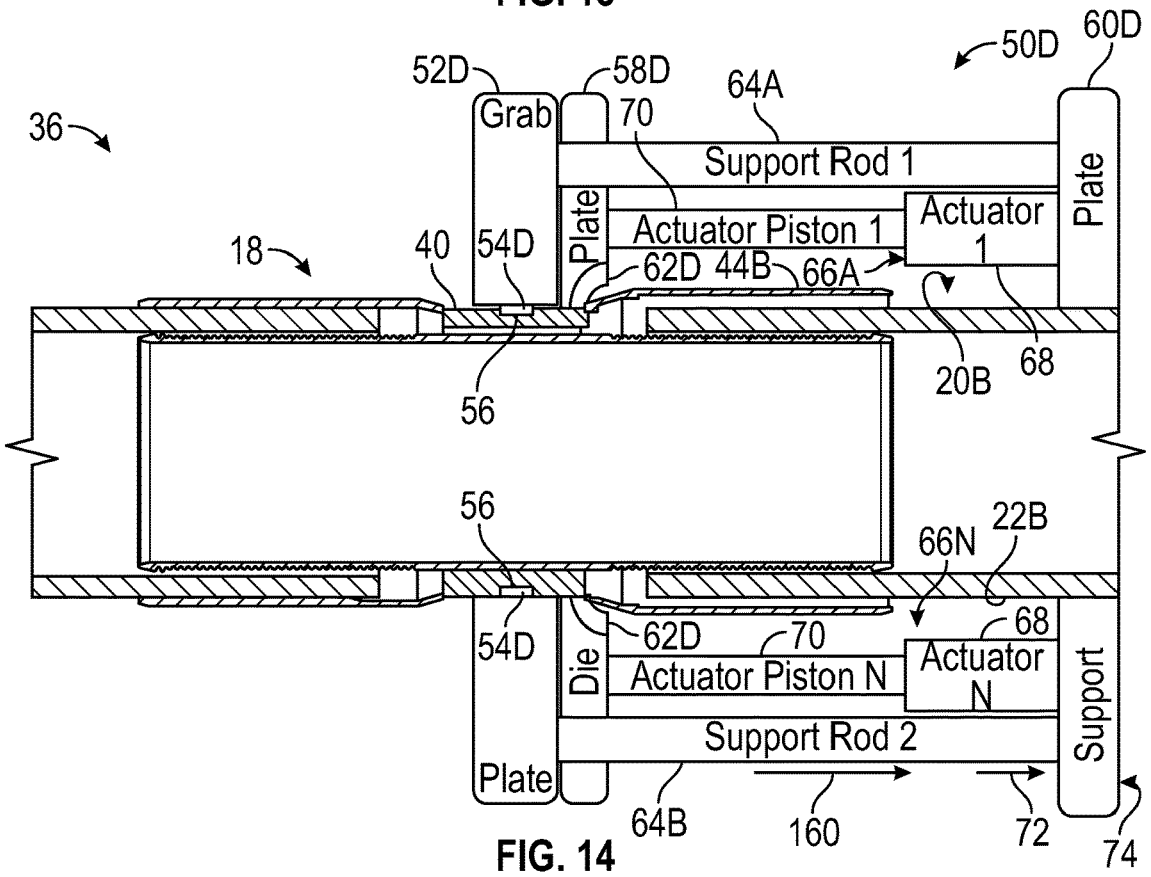
FIG. 14 is an axial cross-section profile of another example of a swage machine and the portion of the pipeline system of FIG. 4, in accordance with an embodiment of the present disclosure.

To help illustrate, another example of a swage machine 50D secured to the portion 36 of the pipeline system 10 is shown in FIG. 14. In particular, as depicted, the swage machine 50D is secured to the grab ring 40 of the pipe fitting 18. To facilitate securing the grab ring 40 thereto, as depicted, the swage machine 50D includes a grab plate 52D, which is implemented (e.g., sized and/or shaped) to matingly interlock with a grab notch 56 on the grab ring 40. As such, in some embodiments, the grab tab 54D in the swage machine 50D of FIG. 14 may generally match the grab tab 54A in the swage machine 50A of FIG. 5.

In any case, as depicted in FIG. 14, the swage machine 50D additionally includes a die plate 58D and a support plate 60D. In particular, as depicted, one or more dies (e.g., die segments) 62D may be loaded (e.g., installed) in the die plate 58D. Furthermore, as in the depicted example, in some embodiments, one or more support rods 64 may be secured to the grab plate 52D and support plate 60D, for example, such that the one or more support rods 64 extend through the die plate 52D. More specifically, in the depicted example, the swage machine 50D includes a first support rod 64A and a second support 64B.

Moreover, in the depicted example, the swage machine 50D includes a first swaging actuator 66A and an Nth swaging actuator 66N. As described above, in some embodiments, one or more swaging actuators 66 of a swage machine 50 may be a hydraulic actuator and/or a pneumatic actuator. In any case, as depicted, the one or more swaging actuators 66 of FIG. 14 each includes an actuator cylinder 68 and an actuator piston 70, which is implemented and/or operated to selectively extend out from the actuator cylinder 68 based at least in part on the supply of fluid (e.g., liquid and/or gas) to the actuator cylinder 68 and/or to selectively retract into the actuator cylinder 68 based at least in part on the extraction of fluid from the actuator cylinder 68.

In particular, as depicted, the actuator pistons 70 of each swaging actuator 66 in the swage machine 50D extends through the die plate 58D and is secured to the grab plate 52D. Additionally, as depicted, the actuator cylinders 68 of each swaging actuator 66 in the swage machine 50D is secured to the support plate 60D, for example, instead of to the die plate 58D. In particular, as in the depicted example, in some embodiments, the actuator cylinders 68 may be secured to an inner surface 72 of the support plate 60D.

However, it should be appreciated that the depicted example is merely intended to be illustrative and not limiting. In particular, in other embodiments, a swage machine 50 may include fewer than two (e.g., one) swaging actuators 66 or more than two (e.g., three, four, or more) swaging actuators 66. Additionally or alternatively, in other embodiments, an actuator cylinder 68 of a swaging actuator 66 in a swage machine 50 may be secured to an outer surface 74 of a support plate 50 in the swage machine 50. Furthermore, in other embodiments, a swaging actuator 66 of a swage machine 50 may be secured to a die plate 58 and a support plate 60 of a swage machine 50 such that its actuator cylinder 68 is secured to the die plate 58 and its actuator piston 70 is secured to the support plate 60. Moreover, in other embodiments, a swage machine 50 may include another type of support member, such as a machine housing 94 of the swage machine 50, secured to its support plate 60 and its grab plate 52 in addition to or as an alternative to one or more support rods 64.

In any case, as depicted in FIG. 14, a die 62D is loaded (e.g., installed) in the die plate 52D of the swage machine 50D such that it opens away from the grab plate 52D of the swage machine 50D and, thus, toward the support plate 60D of the swage machine 50D. As such, the die 62D may facilitate conformally deforming and, thus, swaging the second fitting jacket 44B around the second tubing 22B of the second pipe segment 20B when it is moved over the second fitting jacket 44B in an outwardly axial direction 160 away from the grab plate 52D and, thus, toward the support plate 60D. In other words, to facilitate swaging the second fitting jacket 44B, one or more swaging actuators 66 of the swage machine 50D may be operated to pull the die plate 58D and, thus, one or more dies 62A loaded therein outwardly over the second fitting jacket 44B via one or more reverse (e.g., retracting and/or pulling) strokes. In this manner, a swage machine 50 may be implemented to facilitate swaging a pipe fitting 18 in an outwardly axial direction 160 via one or more actuator reverse strokes.

Figure 15:
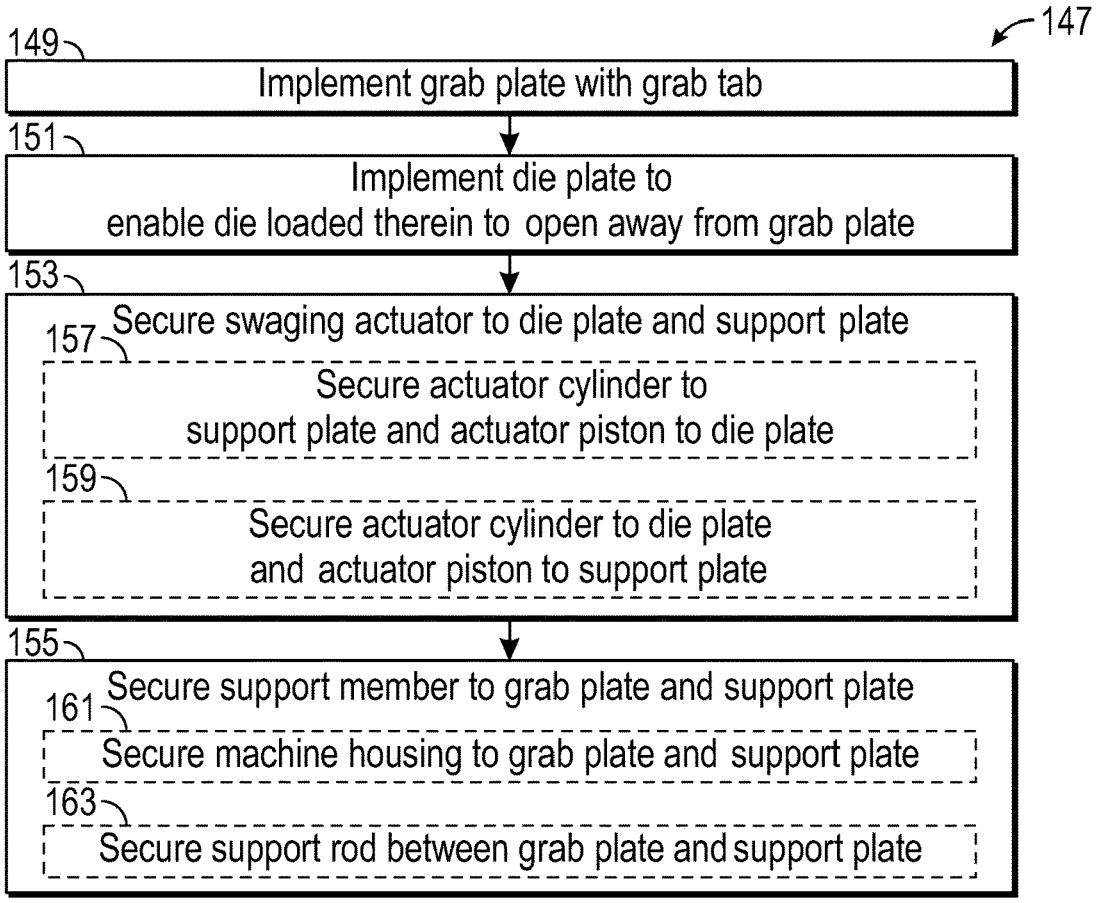
FIG. 15 is a flow diagram of an example of a process for implementing the swage machine of FIG. 14, in accordance with an embodiment of the present disclosure.

To help further illustrate, an example of a process 147 for implementing an outward direction-reverse stroke swage machine 50 is described in FIG. 15. Generally, the process 147 includes implementing a grab plate with a grab tab (process block 149) and implementing a die plate to enable a die loaded therein to open away from the grab plate (process block 151). Additionally, the process 147 generally includes securing a swaging actuator to the die plate and a support plate (process block 153) and securing a support member to the grab plate and the support plate (process block 155).

Although described in a specific order, which corresponds with an embodiment of the present disclosure, it should be appreciated that the example process 147 is merely intended to be illustrative and non-limiting. In particular, in other embodiments, a process 147 for implementing an outward direction-reverse stroke swage machine 50 may include one or more additional process blocks and/or omit one or more of the depicted process blocks. Additionally or alternatively, in other embodiments, one or more of the depicted process blocks may be performed in a different order, for example, such that the die plate is implemented before the grab plate.

In any case, as described above, the (e.g., outward direction-reverse stroke) swage machine 50D of FIG. 14 includes a grab plate 52D with a grab tab 54D, which is implemented (e.g., shaped and/or sized) to matingly interlock with a grab notch 56 on the grab ring 40 of a pipe fitting 18 to be swaged by the swage machine 50D. As such, implementing the swage machine 50D may include implementing a grab plate 52D with a grab tab 54D (process block 149). In some embodiments, the grab plate 52D may be implemented at least in part using metal, such as carbon steel, stainless steel, duplex stainless steel, and/or super duplex stainless steel.

Additionally, as described above, the swage machine 50D of FIG. 14 includes a die plate 58D, which is implemented to enable one or more dies 62D to be loaded (e.g., installed) therein. In particular, as described above, the one or more dies 62D may be loaded into the die plate 58D such that the one or more dies 62D open away from the grab plate 52D of the swage machine 50D. As such, implementing the swage machine 50D may include implementing a die plate 58D to enable one or more dies 62D to be loaded into the die plate 58D such that they open away from the grab plate 52D (process block 151). In some embodiments, the die plate 58D of the swage machine 50D may be implemented at least in part using metal, such as carbon steel, stainless steel, duplex stainless steel, and/or super duplex stainless steel.

Furthermore, as described above, the swage machine 50D of FIG. 14 includes one or more swaging actuators 66. In particular, as described above, the one or more swaging actuators 66 of the swage machine 50D may be secured to the grab plate 52D and a support plate 60D of the swage machine 50D. As such, implementing the swage machine 50D may include securing one or more swaging actuators 66 to the die plate 58D and the support plate 60D of the swage machine 50D (process block 153).

More specifically, as described above, a swaging actuator 66 of a swage machine 50 may include an actuator cylinder 68 and an actuator piston 70. In particular, as depicted in FIG. 14, in some embodiments, a swaging actuator 66 of the swage machine 50D may be secured such that its actuator cylinder 68 is secured to the support plate 60D and its actuator piston 70 is secured to the die plate 58D. Thus, in such embodiments, securing a swaging actuator 66 to the die plate 58D and the support plate 60D may include securing the actuator cylinder 68 of the swaging actuator 66 to the support plate 60D and securing the actuator piston 70 of the swaging actuator 66 to the die plate 58D (process block 157). However, in other embodiments, the actuator cylinder 68 of a swaging actuator 66 may be secured to the die plate 58D and the actuator piston 70 of the swaging actuator 66 may be secured to the support plate 60D. Thus, in such embodiments, securing a swaging actuator 66 to the die plate 58D and the support plate 60D may include securing the actuator cylinder 68 of the swaging actuator 66 to the die plate 58D and securing the actuator piston 70 of the swaging actuator 66 to the support plate 60D (process block 159).

Moreover, as described above, the swage machine 50D of FIG. 14 may include one or more support members secured to its grab plate 52D and its support plate 60D. As such, implementing the swage machine 50D may include securing one or more support members to the grab plate 52D and the support plate 60D of the swage machine 50D (process block 155). In particular, as described above, in some embodiments, a support member of the swage machine 50D may be a machine housing 94 of the swage machine 50D. Thus, in such embodiments, securing the support member to the grab plate 52D and the support plate 60D may include securing a machine housing 94 of the swage machine 50D to the grab plate 52D and the support plate 60D (process block 161). In particular, in some such embodiments, the machine housing 94 of the swage machine 50D may be implemented at least in part using metal, such as carbon steel, stainless steel, duplex stainless steel, and/or super duplex stainless steel.

Additionally or alternatively, as described above, the one or more support members of the swage machine 50D may include one or more support rods 64. Thus, in such embodiments, securing the support member to the grab plate 52D and the support plate 60D may include securing a support rod 64 to the grab plate 52D and the support plate 60D, for example, such that the support rod 64 extends through the die plate 58D of the swage machine 50D to enable the die plate 58D to slide (process block 163). In particular, in some such embodiments, the support rod 64 of the swage machine 50D may be implemented at least in part using metal, such as carbon steel, stainless steel, duplex stainless steel, and/or super duplex stainless steel. By implementing in this manner, a swage machine 50 may be operated to facilitate securing a pipe fitting 18 to the tubing 22 of one or more pipe segments 20 at least in part by swaging the pipe fitting 18 in an outwardly axial direction 160 via one or more actuator reverse (e.g., retracting and/or pulling) strokes.

Figure 16:
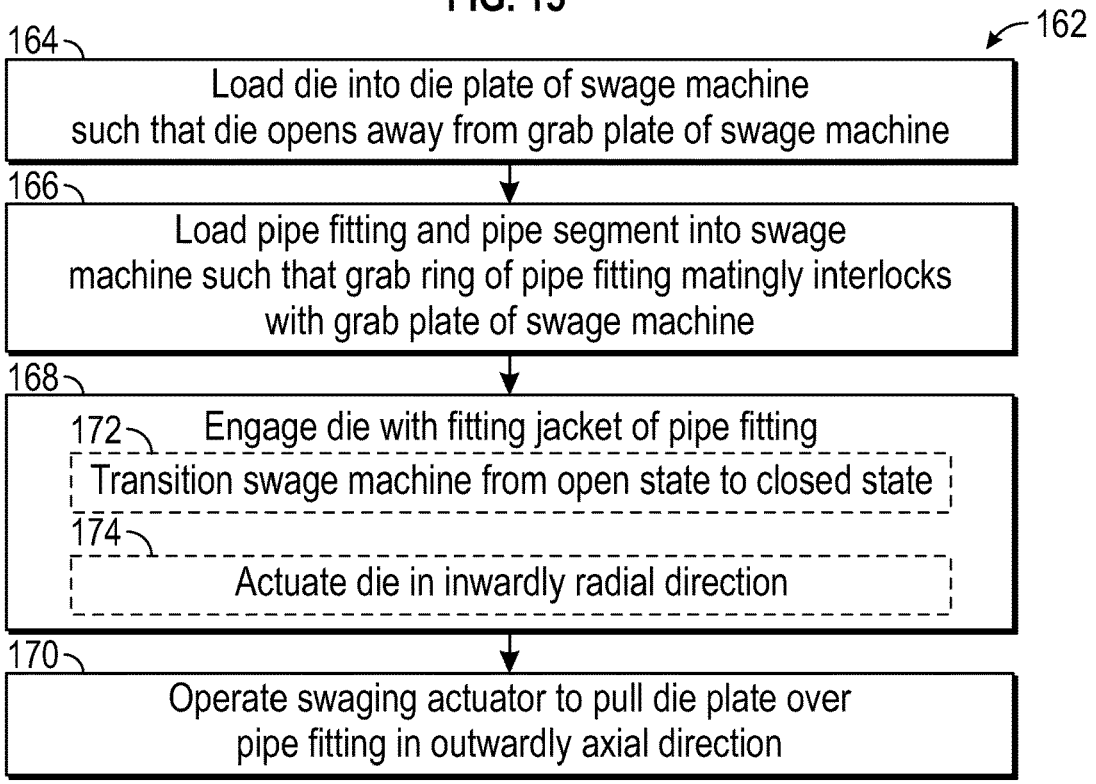
FIG. 16 is a flow diagram of an example of a process for operating the swage machine of FIG. 14, in accordance with an embodiment of the present disclosure.

To help further illustrate, an example of a process 162 for operating an outward direction-reverse stroke swage machine 50 is described in FIG. 16. Generally, the process 162 includes loading a die into a die plate of a swage machine such that the die opens away from a grab plate of the swage machine (process block 164) and loading a pipe fitting and a pipe segment into the swage machine such that a grab ring of the pipe fitting matingly interlocks with the grab plate of the swage machine (process block 166). Additionally, the process 162 generally includes engaging the die with a fitting jacket of the pipe fitting (process block 168) and operating a swaging actuator to pull the die plate over the pipe fitting in an outwardly axial direction (process block 170).

Although described in a specific order, which corresponds with an embodiment of the present disclosure, it should be appreciated that the example process 162 is merely intended to be illustrative and non-limiting. In particular, in other embodiments, a process 162 for operating an outward direction-reverse stroke swage machine 50 may include one or more additional process blocks and/or omit one or more of the depicted process blocks. Additionally or alternatively, in other embodiments, one or more of the depicted process blocks may be performed in a different order, for example, such that the pipe fitting 18 and the pipe segment 20 are loaded into the swage machine 50 before the die 62 is loaded into the die plate 58.

In any case, as described above, one or more dies (e.g., die segments) 62D may be loaded (e.g., installed) in the die plate 58D of the (e.g., outward direction-reverse stroke) swage machine 50D in FIG. 14. In particular, as described above, the die plate 58D may be implemented to enable the one or more dies 62D to be loaded therein such that the one or more dies 62D open away from the grab plate 52D of the swage machine 50D and, thus, toward the support plate 60D of the swage machine 50D. As such, operating the swage machine 50D may include loading one or more dies 62D into its die plate 58D such that the one or more dies 62D open away from its grab plate 52A (process block 164). In some embodiments, the one or more dies 62D may be secured in the die plate 58D via one or more fasteners, such as a C-clamp.

Additionally, as described above, the swage machine 50D of FIG. 14 includes a grab plate 52D with a grab tab 54D, which is implemented (e.g., sized and/or shaped) to matingly interlock with a grab notch 56 on a grab ring 40 of a pipe fitting 18 to be swaged by the swage machine 50D. Furthermore, as described above, a pipe fitting 18 may be secured to a pipe segment 20 at least in part by operating the swage machine 50D to conformally deform a fitting jacket 44 of the pipe fitting 18 around the tubing 22 of the pipe segment 20. As such, operating the swage machine 50D may include loading a pipe fitting 18 and a pipe segment 20 to be secured thereto into the swage machine 50D such that the grab notch 56 on the grab ring 40 of the pipe fitting 18 matingly interlocks with the grab tab 54D on the grab plate 52D of the swage machine 50D (process block 166).

To facilitate swaging the pipe fitting 18, the swage machine 50D may then be operated to engage one or more of its dies 62D with a fitting jacket 44 of the pipe fitting 18 (process block 168). As described above, in some embodiments, a die 62 of a swage machine 50 may be engaged with a portion of a pipeline system 10 that is loaded into the swage machine 50 at least in part by transitioning the swage machine 50 from its opened state in which its housing lid 96 is opened from its housing body 98 to its closed state in which its housing lid 96 is closed onto its housing body 98 (process block 172). Additionally or alternatively, as described above, a die 62 of a swage machine 50 may be engaged with a portion of a pipeline system 10 that is loaded into the swage machine 50 at least in part by operating a die actuator 108 secured to the die 62 to actuate the die 62 in an inwardly radial direction 113 (process block 174).

Moreover, as described above, one or more swaging actuators 66 of the swage machine 50D may then be operated to pull the die plate 58D over the pipe fitting 18 in an outwardly axial direction 160 away from the grab plate 52D and, thus, toward the support plate 60D via one or more reverse (e.g., retracting and/or pulling) strokes (process block 170). In particular, as described above, a swaging actuator 66 of the swage machine 50D may be secured between the die plate 58D and the support plate 60D of the swage machine 50D, for example, such that its actuator cylinder 68 is secured to the support plate 60D and its actuator piston 70 is secured to the die plate 58D or vice versa. As such, to facilitate pulling the die plate 58D over the pipe fitting 18, fluid may be extracted from the actuator cylinder 68 of the swaging actuator 66 to cause the actuator piston 70 of the swaging actuator 66 to retract farther into the actuator cylinder 68. In this manner, a swage machine 50 may be operated to facilitate securing a pipe fitting 18 to the tubing 22 of a pipe segment 20 at least in part by swaging the pipe fitting 18 in an outwardly axial direction 160 via a reverse (e.g., retracting and/or pulling) strokes of one or more swaging actuators 66.

However, actuation strength of a reverse (e.g., retracting and/or pulling) stroke of a swaging actuator 66 is generally less than the actuation strength of a forward (e.g., extending and/or pushing) stroke of the swaging actuator 66. For example, in some instances, the actuation strength of the reverse stroke may be half the actuation strength of the forward stroke. In other words, to produce the same actuation strength, in such instances, a swaging actuator 66 implemented in a reverse stroke (e.g., pulling) swage machine 50 may be twice as large as a swaging actuator 66 implemented in a forward stroke (e.g., pushing) swage machine 50. As such, to facilitate increasing its actuation strength, in other embodiments, a swage machine 50 may be implemented and/or operated to push its die plate 52 and, thus, one or more dies 62 loaded therein away from its grab plate 52 via one or more actuator forward strokes.

Figure 17:
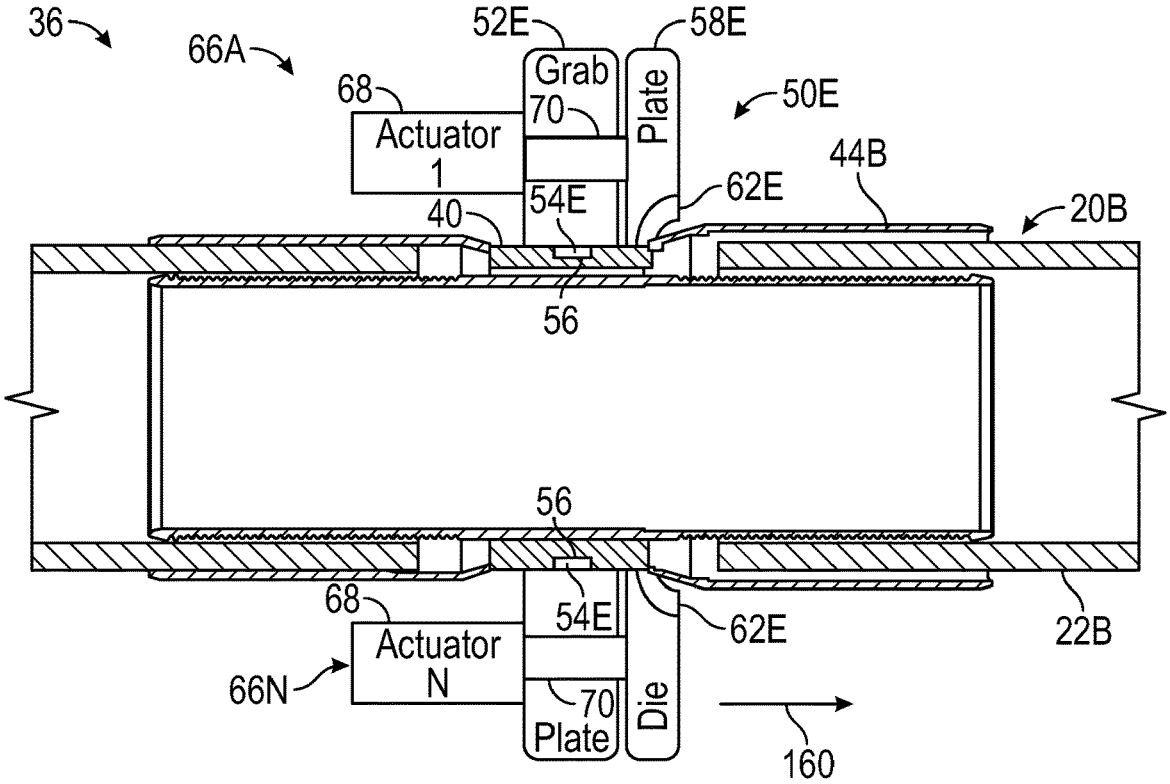
FIG. 17 is an axial cross-section profile of another example of a swage machine and the portion of the pipeline system of FIG. 4, in accordance with an embodiment of the present disclosure.

To help illustrate, another example of a swage machine 50E secured to the portion 36 of the pipeline system 10 is shown in FIG. 17. In particular, as depicted, the swage machine 50E is secured to the grab ring 40 of the pipe fitting 18. To facilitate securing the grab ring 40 thereto, as depicted, the swage machine 50E includes a grab plate 52E, which is implemented (e.g., sized and/or shaped) to matingly interlock with a grab notch 56 on the grab ring 40. As such, in some embodiments, the grab tab 54E in the swage machine 50E of FIG. 17 may generally match the grab tab 54A in the swage machine 50A of FIG. 5.

In any case, as depicted in FIG. 17, the swage machine 50E additionally includes a die plate 58E. In particular, as depicted, one or more dies (e.g., die segments) 62E may be loaded (e.g., installed) in the die plate 58E. In some embodiments, the one or more dies 62E of FIG. 17 may generally match the one or more dies 62D of FIG. 14.

Moreover, in the depicted example, the swage machine 50E includes a first swaging actuator 66A and an Nth swaging actuator 66N. As described above, in some embodiments, one or more swaging actuators 66 of a swage machine 50 may be a hydraulic actuator and/or a pneumatic actuator. In any case, as depicted, the one or more swaging actuators 66 of FIG. 17 each include an actuator cylinder 68 and an actuator piston 70, which is implemented and/or operated to selectively extend out from the actuator cylinder 68 based at least in part on the supply of fluid (e.g., liquid and/or gas) to the actuator cylinder 68 and/or to selectively retract into the actuator cylinder 68 based at least in part on the extraction of fluid from the actuator cylinder 68. In particular, as in the depicted example, in the embodiments, the actuator cylinder 68 of each swaging actuator 66 may be secured to the grab plate 52E and the actuator piston 70 of each swaging actuator 66 may extend through the grab plate 52E and be secured to the die plate 58E.

However, it should be appreciated that the depicted example is merely intended to be illustrative and not limiting. In particular, in other embodiments, a swage machine 50 may include fewer than two (e.g., one) swaging actuators 66 or more than two (e.g., three, four, or more) swaging actuators 66. Moreover, in other embodiments, a swage machine 50 may additionally include one or more support members, such as a machine housing 94 and/or a support rod 64.

In any case, as depicted in FIG. 17, a die 62E is loaded (e.g., installed) in the die plate 52E of the swage machine 50E such that it opens away from the grab plate 52E of the swage machine 50E. As such, the die 62E may facilitate conformally deforming and, thus, swaging the second fitting jacket 44B around the second tubing 22B of the second pipe segment 20B when it is moved over the second fitting jacket 44B in an outwardly axial direction 160 away from the grab plate 52E. In other words, to facilitate swaging the second fitting jacket 44B, one or more swaging actuators 66 of the swage machine 50E may be operated to push the die plate 58E and, thus, one or more dies 62E loaded therein outwardly over the second fitting jacket 44B via one or more forward (e.g., extending and/or pushing) strokes. In this manner, a swage machine 50 may be implemented to facilitate swaging a pipe fitting 18 in an outwardly axial direction 160 via one or more actuator forward strokes.

Figure 18:
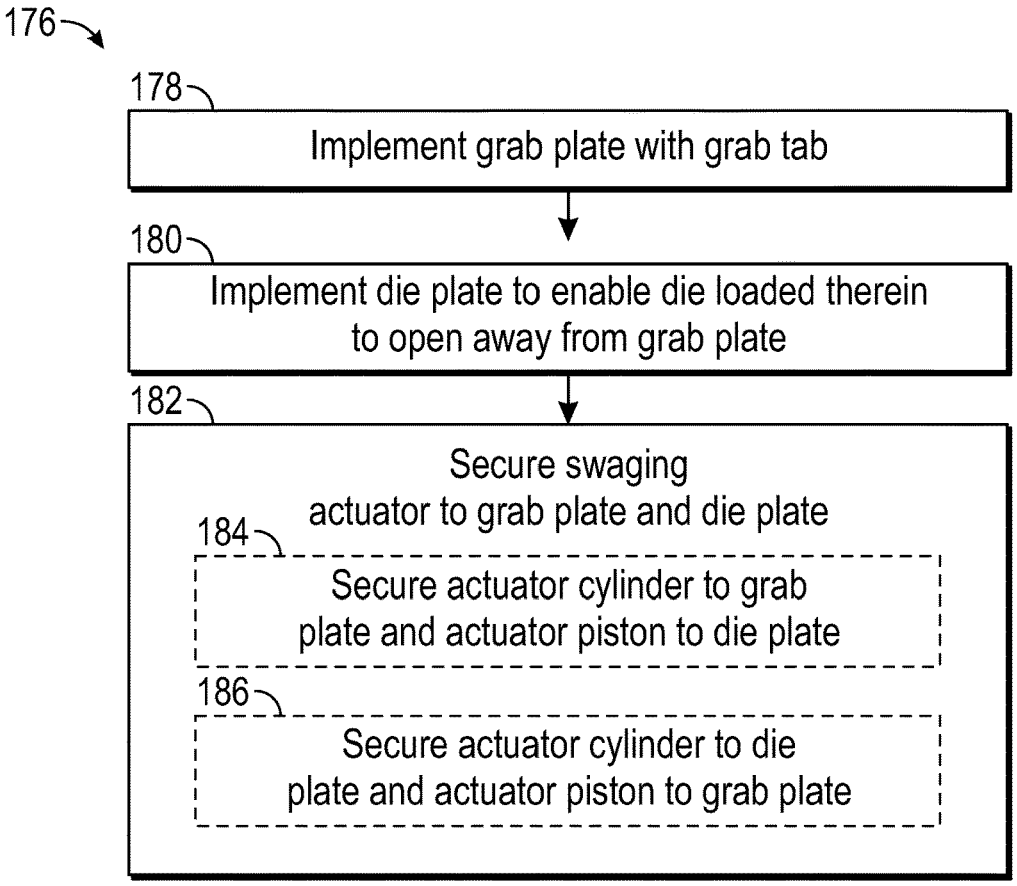
FIG. 18 is a flow diagram of an example of a process for implementing the swage machine of FIG. 17, in accordance with an embodiment of the present disclosure.

To help further illustrate, another example of a process 176 for implementing a (e.g., outward direction-forward stroke) swage machine 50 is described in FIG. 18. Generally, the process 176 includes implementing a grab plate with a grab tab (process block 178) and implementing a die plate to enable a die loaded therein to open away from the grab plate (process block 180). Additionally, the process 176 generally includes securing a swaging actuator to the grab plate and the die plate (process block 182).

Although described in a specific order, which corresponds with an embodiment of the present disclosure, it should be appreciated that the example process 176 is merely intended to be illustrative and non-limiting. In particular, in other embodiments, a process 176 for implementing a swage machine 50 may include one or more additional process blocks and/or omit one or more of the depicted process blocks. Additionally or alternatively, in other embodiments, one or more of the depicted process blocks may be performed in a different order, for example, such that the die plate 58 is implemented before the grab plate 52.

In any case, as described above, the (e.g., outward direction-forward stroke) swage machine 50E of FIG. 17 includes a grab plate 52E with a grab tab 54E, which is implemented (e.g., shaped and/or sized) to matingly interlock with a grab notch 56 on the grab ring 40 of a pipe fitting 18 to be swaged by the swage machine 50E. As such, implementing the swage machine 50E may include implementing a grab plate 52E with a grab tab 54E (process block 178). In some embodiments, the grab plate 52E may be implemented at least in part using metal, such as carbon steel, stainless steel, duplex stainless steel, and/or super duplex stainless steel.

Additionally, as described above, the swage machine 50E of FIG. 17 includes a die plate 58E, which is implemented to enable one or more dies 62E to be loaded (e.g., installed) therein. In particular, as described above, the die plate 58E of the swage machine 50E may be implemented to enable the one or more dies 62E to be loaded therein such that the one or more dies 62E open away from the grab plate 52E of the swage machine 50E. As such, implementing the swage machine 50E may include implementing a die plate 58E to enable one or more dies 62E to be loaded into the die plate 58E such that they open away from the grab plate 52E (process block 180). In some embodiments, the die plate 58E of the swage machine 50E may be implemented at least in part using metal, such as carbon steel, stainless steel, duplex stainless steel, and/or super duplex stainless steel.

Furthermore, as described above, the swage machine 50E of FIG. 17 includes one or more swaging actuators 66. In particular, as described above, the one or more swaging actuators 66 of the swage machine 50E may be secured to the grab plate 52E and the die plate 58E of the swage machine 50E. As such, implementing the swage machine 50E may include securing one or more swaging actuators 66 to the die plate 58E and the grab plate 52E of the swage machine 50E (process block 182).

Moreover, as described above, a swaging actuator 66 of a swage machine 50 may include an actuator cylinder 68 and an actuator piston 70. In particular, as depicted in FIG. 17, in some embodiments, a swaging actuator 66 of the swage machine 50E may be secured such that its actuator cylinder 68 is secured to the grab plate 52E and its actuator piston 70 extends through the grab plate 52E and is secured to the die plate 58E. Thus, in such embodiments, securing a swaging actuator 66 to the die plate 58E and the grab plate 52E may include securing the actuator cylinder 68 of the swaging actuator 66 to the grab plate 52E and securing the actuator piston 70 of the swaging actuator 66 to the die plate 58E (process block 184).

However, in other embodiments, the actuator cylinder 68 of a swaging actuator 66 may be secured to the die plate 58E and the actuator piston 70 of the swaging actuator 66 may be secured to the grab plate 52E. Thus, in such embodiments, securing a swaging actuator 66 to the die plate 58E and the grab plate 52E may include securing the actuator cylinder 68 of the swaging actuator 66 to the die plate 58E and securing the actuator piston 70 of the swaging actuator 66 to the grab plate 52E (process block 186). By implementing in this manner, a swage machine 50 may be operated to facilitate securing a pipe fitting 18 to the tubing 22 of one or more pipe segments 20 at least in part by swaging the pipe fitting 18 in an outwardly axial direction 160 via one or more actuator forward (e.g., extending and/or pushing) strokes.

Figure 19:
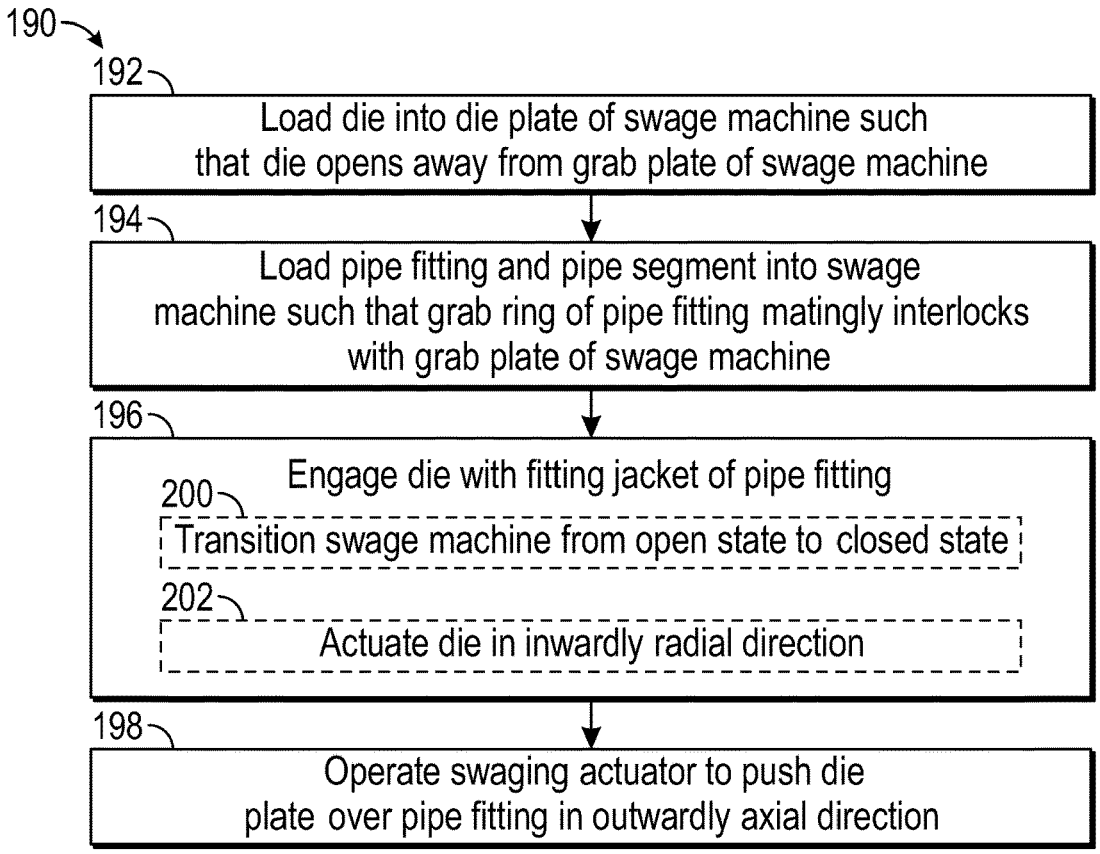
FIG. 19 is a flow diagram of an example of a process for operating the swage machine of FIG. 17, in accordance with an embodiment of the present disclosure.

To help further illustrate, an example of a process 190 for operating an outward direction-forward stroke swage machine 50 is described in FIG. 19. Generally, the process 190 includes loading a die into a die plate of a swage machine such that the die opens away from a grab plate of the swage machine (process block 192) and loading a pipe fitting and a pipe segment into the swage machine such that a grab ring of the pipe fitting matingly interlocks with the grab pate of the swage machine (process block 194). Additionally, the process 190 generally includes engaging the die with a fitting jacket of the pipe fitting (process block 196) and operating a swaging actuator to push the die plate over the pipe fitting in an outwardly axial direction (process block 198).

Although described in a specific order, which corresponds with an embodiment of the present disclosure, it should be appreciated that the example process 190 is merely intended to be illustrative and non-limiting. In particular, in other embodiments, a process 190 for operating an outward direction-forward stroke swage machine 50 may include one or more additional process blocks and/or omit one or more of the depicted process blocks. Additionally or alternatively, in other embodiments, one or more of the depicted process blocks may be performed in a different order, for example, such that the pipe fitting 18 and the pipe segment 20 are loaded into the swage machine 50 before the die 62 is loaded into the die plate 58.

In any case, as described above, one or more dies (e.g., die segments) 62E may be loaded (e.g., installed) in the die plate 58E of the (e.g., outward direction-forward stroke) swage machine 50E in FIG. 17. In particular, as described above, the die plate 58E of the swage machine 50E may be implemented to enable the one or more dies 62E to be loaded therein such that they open away from the grab plate 52E of the swage machine 50E. As such, operating the swage machine 50E may include loading one or more dies 62E into its die plate 58E such that the one or more dies 62E open away from its grab plate 52E (process block 192). In some embodiments, the one or more dies 62E may be secured in the die plate 58E via one or more fasteners, such as a C-clamp.

Additionally, as described above, the swage machine 50E of FIG. 17 includes a grab plate 52E with a grab tab 54E, which is implemented (e.g., sized and/or shaped) to matingly interlock with a grab notch 56 on a grab ring 40 of a pipe fitting 18 to be swaged by the swage machine 50E. Furthermore, as described above, a pipe fitting 18 may be secured to a pipe segment 20 at least in part by operating the swage machine 50E to conformally deform a fitting jacket 44 of the pipe fitting 18 around the tubing 22 of the pipe segment 20. As such, operating the swage machine 50A may include loading a pipe fitting 18 and a pipe segment 20 to be secured thereto into the swage machine 50E such that the grab notch 56 on the grab ring 40 of the pipe fitting 18 matingly interlocks with the grab tab 54E on the grab plate 52E of the swage machine 50E (process block 194).

To facilitate swaging the pipe fitting 18, the swage machine 50E may then be operated to engage one or more of its dies 62E with a fitting jacket 44 of the pipe fitting 18 (process block 196). As described above, in some embodiments, a die 62 of a swage machine 50 may be engaged with a portion of a pipeline system 10 that is loaded into the swage machine 50 at least in part by transitioning the swage machine 50 from its opened state in which its housing lid 96 is opened from its housing body 98 to its closed state in which its housing lid 96 is closed onto its housing body 98 (process block 200). Additionally or alternatively, as described above, a die 62 of a swage machine 50 may be engaged with a portion of a pipeline system 10 that is loaded into the swage machine 50 at least in part by operating a die actuator 108 secured to the die 62 to actuate the die 62 in an inwardly radial direction 113 (process block 202).

Moreover, as described above, one or more swaging actuators 66 of the swage machine 50E may then be operated to push the die plate 58E over the pipe fitting 18 in an outwardly axial direction 160 away from the grab plate 52E via one or more forward (e.g., extracting) strokes (process block 198). In particular, as described above, a swaging actuator 66 of the swage machine 50E may be secured to the grab plate 52E and the die plate 58E of the swage machine 50E, for example, such that its actuator cylinder 68 is secured to the grab plate 52E and its actuator piston 70 extends through the grab plate 52E and is secured to the die plate 58E or vice versa. As such, to facilitate pushing the die plate 58E over the pipe fitting 18, fluid may be supplied to the actuator cylinder 68 of the swaging actuator 66 to cause the actuator piston 70 of the swaging actuator 66 to extend out farther from the actuator cylinder 68. In this manner, a swage machine 50 may be operated to facilitate securing a pipe fitting 18 to the tubing 22 of a pipe segment 20 at least in part by swaging the pipe fitting 18 in an outwardly axial direction 160 via a forward (e.g., extending and/or pushing) strokes of one or more swaging actuators 66.

As described above, in some instances, a pipe fitting 18, such as a midline pipe fitting 18, may include multiple fitting jackets 44. To facilitate improving swaging efficiency, in some embodiments, a swage machine 50 may be implemented and/or operated to concurrently swage multiple fitting jackets 44 of the pipe fitting 18. In particular, such a swage machine 50 may be implemented at least in part by implementing two instances of a swage machine 50 described above back-to-back such that they share a grab plate 52.

For example, a swage machine 50 that is capable of concurrently swaging multiple fitting jackets 44 of a pipe fitting 18 in corresponding inwardly axial directions 76 via forward (e.g., extending and/or pushing) strokes of its swaging actuators 66 may be implemented at least in part by implementing two instances of the swage machine 50A in FIG. 5 back-to-back such that they share a grab plate 52A. Additionally, a swage machine 50 that is capable of concurrently swaging multiple fitting jackets 44 of a pipe fitting 18 in corresponding inwardly axial directions 76 via reverse strokes of its swaging actuators 66 may be implemented at least in part by implementing two instances of the swage machine 50B in FIG. 10 back-to-back such that they share a grab plate 52B. Furthermore, a swage machine 50 that is capable of concurrently swaging multiple fitting jackets 44 of a pipe fitting 18 in corresponding outwardly axial directions 160 via reverse strokes of its swaging actuators 66 may be implemented at least in part by implementing two instances of the swage machine 50D in FIG. 14 back-to-back such that they share a grab plate 52D. Moreover, a swage machine 50 that is capable of concurrently swaging multiple fitting jackets 44 of a pipe fitting 18 in corresponding outwardly axial directions 160 via forward strokes of its swaging actuators 66 may be implemented at least in part by implementing two instances of the swage machine 50E in FIG. 17 back-to-back such that they share a grab plate 52E.

Figure 20:
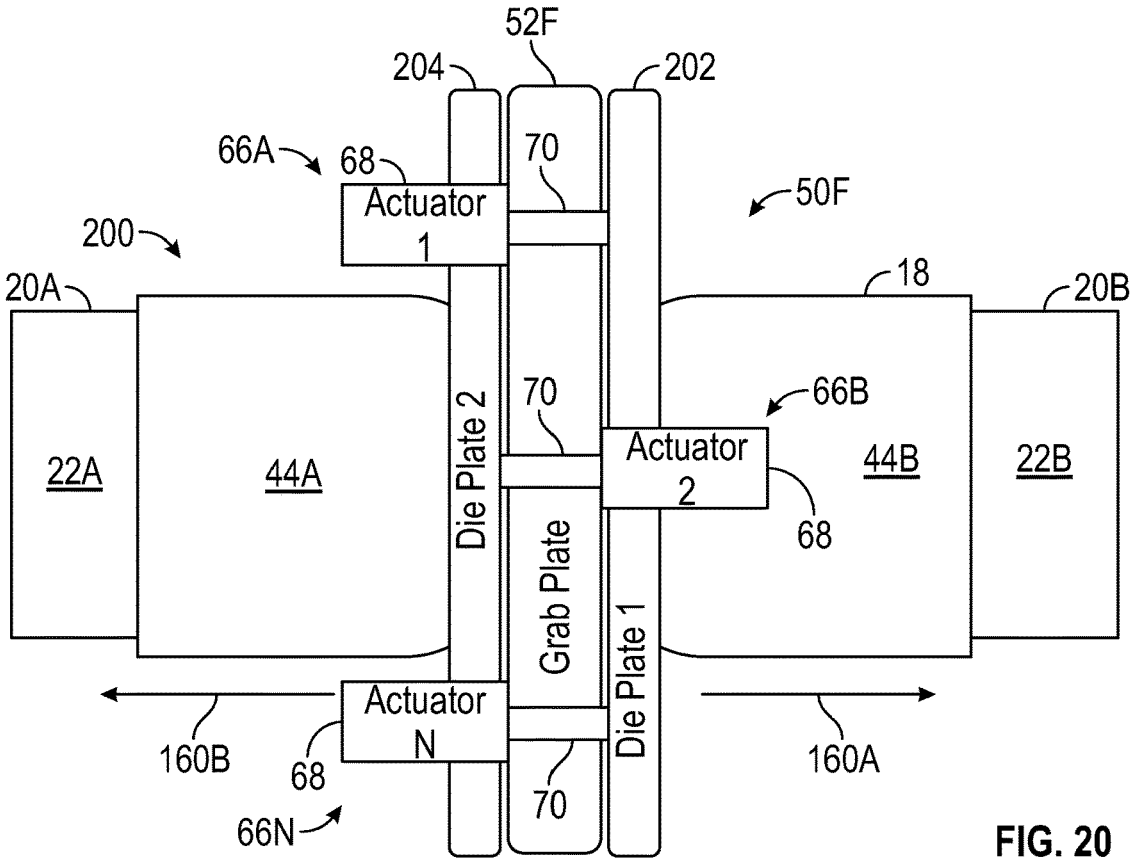
FIG. 20 is an axial profile of another example of a swage machine and a portion of the pipeline system of FIG. 1, in accordance with an embodiment of the present disclosure.

To help further illustrate, another example of a swage machine 50F secured to a portion 200 of a pipeline system 10 is shown in FIG. 20. As depicted, the portion 200 of the pipeline system 10 includes a first pipe segment 20A, a second pipe segment 20B, and a pipe fitting 18. In particular, as depicted, the pipe fitting 18 is disposed between the first pipe segment 20A and the second pipe segment 20B.

In other words, the pipe fitting 18 of FIG. 20 may be a midline pipe fitting 18. However, it should be appreciated that the depicted example is merely intended to be illustrative and not limiting. In particular, in other embodiments, the techniques described in the present disclosure may additionally or alternatively be used with other types of pipe fittings 18, such as a pipe end fitting 18.

In any case, as depicted, the pipe fitting 18 includes fitting jackets 44—namely a first fitting jacket 44A and a second fitting jacket 44B. In particular, although obfuscated from view, first tubing 22A of the first pipe segment 20A is disposed within a first tubing cavity 46A of the pipe fitting 18, which is defined between the first fitting jacket 44A and a fitting tube 38 of the pipe fitting 18. As such, to facilitate securing the pipe fitting 18 to the first pipe segment 20A, the first fitting jacket 44A may be swaged at least in part by conformally deforming the first fitting jacket 44A around the first tubing 22A of the first pipe segment 20A. Similarly, although obfuscated from view, second tubing 22B of the second pipe segment 20B is disposed within a second tubing cavity 46B of the pipe fitting 18, which is defined between the second fitting jacket 44B and the fitting tube 38 of the pipe fitting 18. As such, to facilitate securing the pipe fitting 18 to the second pipe segment 20B, the second fitting jacket 44B may be swaged at least in part by conformally deforming the second fitting jacket 44B around the second tubing 22B of the second pipe segment 20B.

To enable concurrently swaging the first fitting jacket 44A and the second fitting jacket 44B, as depicted, the swage machine 50F includes die plates 58—namely a first die plate 202 and a second die plate 204—in addition to a grab plate 52F. Although obfuscated from view, a first one or more dies 62 may be loaded (e.g., installed) in the first die plate 202. Similarly, although obfuscated from view, a second one or more dies 62 may be loaded in the second die plate 204.

To facilitate moving its dies 62 over corresponding fitting jackets 44 of the pipe fitting 18, as depicted, the swage machine 50F includes swaging actuators 66. As described above, in some embodiments, one or more swaging actuators 66 of a swage machine 50 may be a hydraulic actuator and/or a pneumatic actuator. In any case, similar to the swage machine 50E in FIG. 17, the swage machine 50F in FIG. 20 includes a first swaging actuator 66A and an Nth swaging actuator 66N, which are secured to the grab plate 52F and a die plate 58—namely the first die plate 202. As depicted, the swage machine 50F additionally includes a second swaging actuator 66B, which is secured to the grab plate 52F and the second die plate 204.

However, it should be appreciated that the depicted example is merely intended to be illustrative and not limiting. In particular, in other embodiments, a swage machine 50 may include fewer than two (e.g., one) swaging actuators 66 or more than two (e.g., three, four, or more) swaging actuators 66 secured to its grab plate 52 and its first die plate 202. Additionally or alternatively, a swage machine 50 may include fewer than two (e.g., one) swaging actuators 66 or more than two (e.g., three, four, or more) swaging actuators 66 secured to its grab plate 52 and its second die plate 204. For example, the swage machine 50 may additionally include an N+1th swaging actuator 66 secured to its grab plate 52 and its second die plate 204. Moreover, in other embodiments, a swage machine 50 may additionally include one or more support members, such as a machine housing 94 and/or a support rod 64.

In any case, as depicted, each swaging actuator 66 of the swage machine 50F includes an actuator cylinder 68 and an actuator piston 70. In particular, as depicted, the actuator cylinder 68 of each swaging actuator 66 in the swage machine 50F is secured to the grab plate 52F of the swage machine 50F. Additionally, as depicted, the actuator pistons 70 of the first swaging actuator 66A and the Nth swaging actuator 66N are secured to the first die plate 202 while the actuator piston 70 of the second swaging actuator 66B is secured to the second die plate 204.

Furthermore, although obfuscated from view, a first die 62 may be loaded into the first die plate 202 and the second die 62 may be loaded into the second die plate 204 such that they each open away from the grab plate 52F of the swage machine 50F. As such, the first die 62 loaded in the first die plate 202 may facilitate conformally deforming and, thus, swaging the second fitting jacket 44B around the second tubing 22B of the second pipe segment when it is moved over the second fitting jacket 44B in a first outwardly axial direction 160A away from the grab plate 52F. Similarly, the second die 62 loaded in the second die plate 204 may facilitate conformally deforming and, thus, swaging the first fitting jacket 44A around the first tubing 22A of the first pipe segment when it is moved over the first fitting jacket 44A in a second outwardly axial direction 160B away from the grab plate 52F. In other words, to facilitate concurrently swaging the first fitting jacket 44A and the second fitting jacket 44B, swaging actuators 66 (e.g., first swaging actuator 66A and second swaging actuator 66B) of the swage machine 50F may be operated to concurrently push the first die plate 202 outwardly over the second fitting jacket 44B and the second die plate 202 outwardly over the first fitting jacket 44A via forward (e.g., extending and/or pushing) strokes. In this manner, a swage machine 50 may be implemented to enable concurrently swaging multiple fitting jackets 44 of a pipe fitting in outwardly axial directions 160 via actuator forward strokes.

Figure 21:
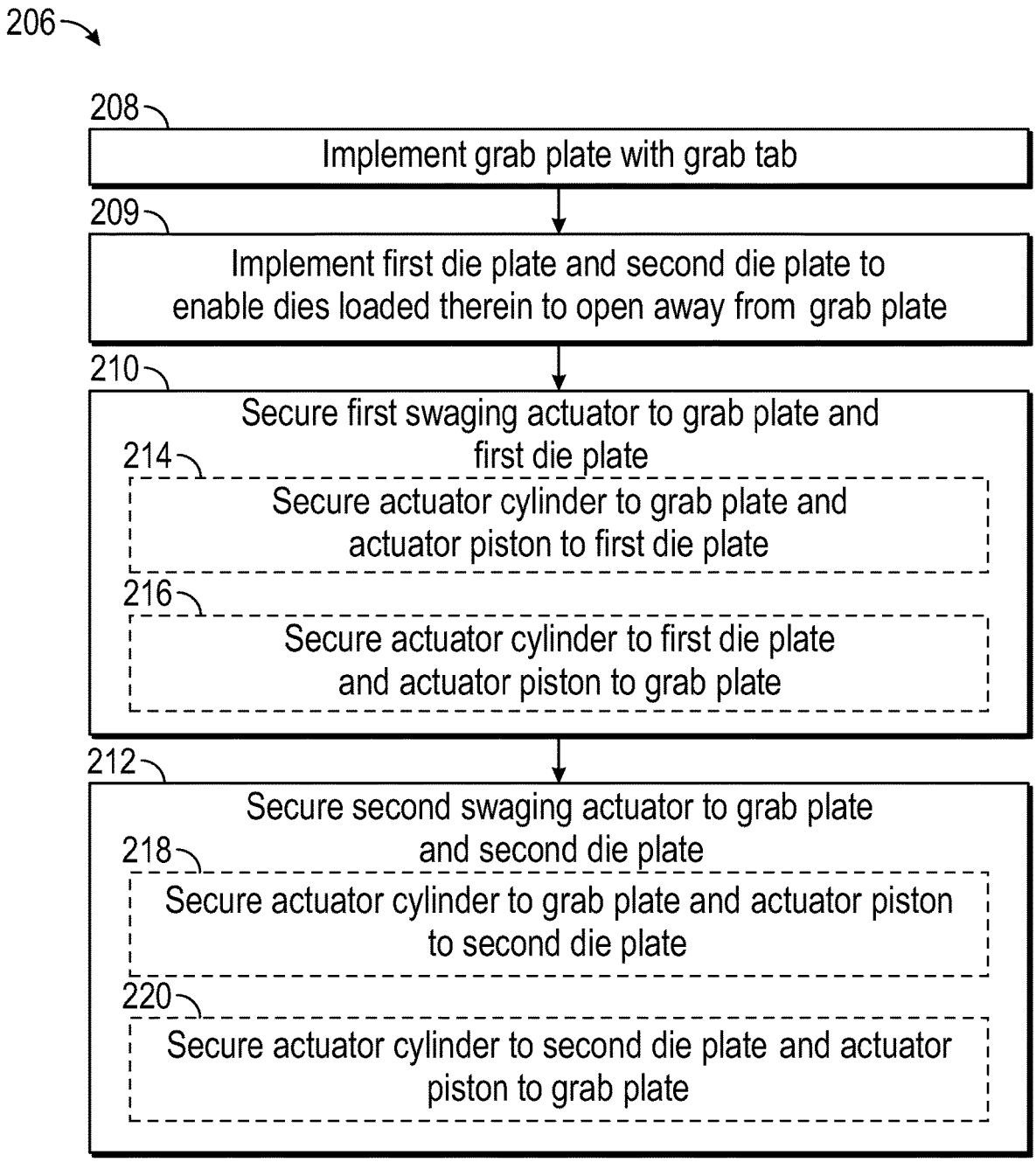
FIG. 21 is an example of a process for implementing the swage machine of FIG. 20, in accordance with an embodiment of the present disclosure.

To help further illustrate, an example of a process 206 for implementing a swage machine 50 to enable to the swage machine 50 to concurrently swage multiple fitting jackets 44 of a pipe fitting 18 is described in FIG. 21. Generally, the process 206 includes implementing a grab plate with a grab tab (process block 208) and implementing a first die plate and a second die plate to enable dies loaded therein to open away from the grab plate (process block 209). Additionally, the process 206 generally includes securing a first swaging actuator to the grab plate and the first die plate (process block 210) and securing a second swaging actuator to the grab plate and the second die plate (process block 212).

Although described in a specific order, which corresponds with an embodiment of the present disclosure, it should be appreciated that the example process 206 is merely intended to be illustrative and non-limiting. In particular, in other embodiments, a process 206 for implementing a swage machine 50 to enable to the swage machine 50 to concurrently swage multiple fitting jackets 44 of a pipe fitting 18 may include one or more additional process blocks and/or omit one or more of the depicted process blocks. Additionally or alternatively, in other embodiments, one or more of the depicted process blocks may be performed in a different order, for example, such that the second swaging actuator 66B is secured before the first swaging actuator 66A.

In any case, as described above, the swage machine 50F of FIG. 20 includes a grab plate 52F with a grab tab 54, which is implemented (e.g., shaped and/or sized) to matingly interlock with a grab notch 56 on the grab ring 40 of a pipe fitting 18 to be swaged by the swage machine 50F. As such, implementing the swage machine 50F may include implementing a grab plate 52F with a grab tab 54 (process block 208). In some embodiments, the grab plate 52F may be implemented at least in part using metal, such as carbon steel, stainless steel, duplex stainless steel, and/or super duplex stainless steel.

Additionally, as described above, the swage machine 50F of FIG. 20 includes a first die plate 202 and a second die plate 204, which are each implemented to enable one or more dies 62 to be loaded (e.g., installed) therein. In particular, as described above, the first die plate 202 of the swage machine 50F may be implemented to enable a first one or more dies 62 to be loaded therein such that the one or more dies 62 open away from the grab plate 52F of the swage machine 50F and the second die plate 204 of the swage machine 50F may be implemented to enable a second one or more dies 62 to be loaded therein such that the one or more dies open away from the grab plate 52F of the swage machine 50F. As such, implementing the swage machine 50F may include implementing a first die plate 202 and a second die plate 204 each to enable one or more dies 62 to be loaded therein such that they open away from the grab plate 52F (process block 209).

Furthermore, as described above, the swage machine 50F of FIG. 20 includes multiple swaging actuators 66. In particular, as described above, a first swaging actuator 66A of the swage machine 50F is secured to the grab plate 52F and the first die plate 202 of the swage machine 50F. As such, implementing the swage machine 50F may include securing a first swaging actuator 66A to the grab plate 52F and the first die plate 202 of the swage machine 50F (process block 210).

In addition to the first swaging actuator 66A, as described above, the swage machine 50F of FIG. 20 includes a second swaging actuator 66B. In particular, as described above, the second swaging actuator 66B of the swage machine 50F is secured to the grab plate 52F and the second die plate 204 of the swage machine 50F. As such, implementing the swage machine 50F may include securing a second swaging actuator 66B to the grab plate 52F and the second die plate 204 of the swage machine 50F (process block 212).

Moreover, as described above, a swaging actuator 66 of a swage machine 50 may include an actuator cylinder 68 and an actuator piston 70. In particular, as depicted in FIG. 20, in some embodiments, the first swaging actuator 66A of the swage machine 50F may be secured such that its actuator cylinder 68 is secured to the grab plate 52F and its actuator piston 70 extends through the grab plate 52F and is secured to the first die plate 202. Thus, in such embodiments, securing the first swaging actuator 66A to the first die plate 202 and the grab plate 52F may include securing the actuator cylinder 68 of the first swaging actuator 66A to the grab plate 52F and securing the actuator piston 70 of the first swaging actuator 66A to the first die plate 202 (process block 214). However, in other embodiments, the first swaging actuator 66A may be secured such that its actuator cylinder 68 is secured to the first die plate 202 and its actuator piston 70 extend through the first die plate 202 and is secured to the grab plate 52F. Thus, in such embodiments, securing the first swaging actuator 66A to the first die plate 58F and the grab plate 52F may include securing the actuator cylinder 68 of the first swaging actuator 66A to the first die plate 202 and securing the actuator piston 70 of the first swaging actuator 66A to the grab plate 58F (process block 216).

Additionally, as depicted in FIG. 20, in some embodiments, the second swaging actuator 66B of the swage machine 50F may be secured such that its actuator cylinder 68 is secured to the grab plate 52F and its actuator piston 70 extends through the grab plate 52F and is secured to the second die plate 204. Thus, in such embodiments, securing the second swaging actuator 66B to the second die plate 202 and the grab plate 52F may include securing the actuator cylinder 68 of the second swaging actuator 66B to the grab plate 52F and securing the actuator piston 70 of the second swaging actuator 66B to the first die plate 202 (process block 218). However, in other embodiments, the second swaging actuator 66B may be secured such that its actuator cylinder 68 is secured to the second die plate 204 and its actuator piston 70 extend through the second die plate 204 and is secured to the grab plate 52F. Thus, in such embodiments, securing the second swaging actuator 66B to the second die plate 204 and the grab plate 52F may include securing the actuator cylinder 68 of the second swaging actuator 66B to the second die plate 204 and securing the actuator piston 70 of the second swaging actuator 66B to the grab plate 58F (process block 220). By implementing in this manner, a swage machine 50 may be operated to facilitate concurrently securing a pipe fitting 18 to multiple pipe segments 20 at least in part by concurrently swaging the pipe fitting 18 around the tubing 22 of each of the pipe segments 20.

Figure 22:
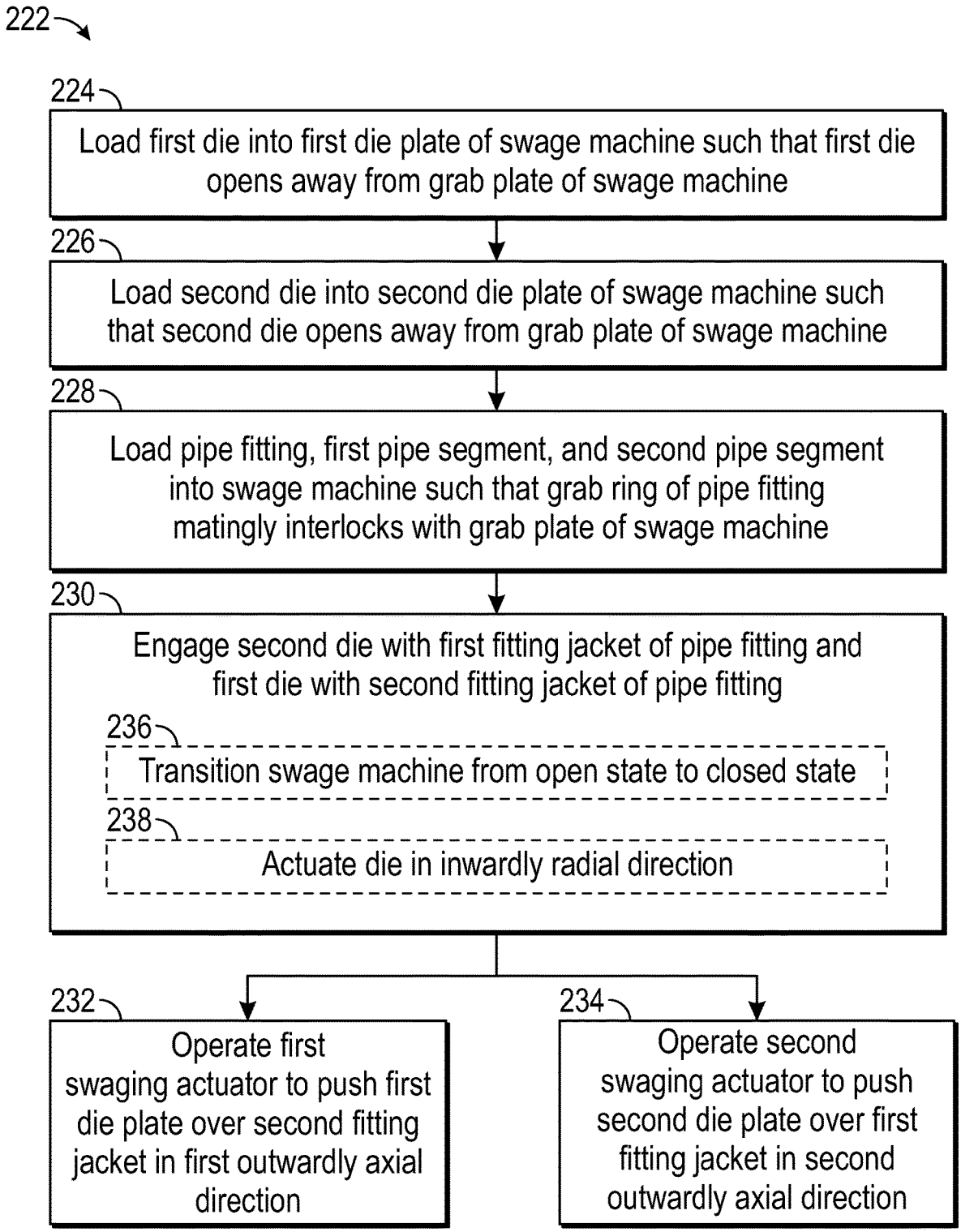
FIG. 22 is an example of a process for operating the swage machine of FIG. 20, in accordance with an embodiment of the present disclosure.

To help further illustrate, an example of a process 222 for operating a swage machine 50 to concurrently swage multiple fitting jackets 44 of a pipe fitting 18 is described in FIG. 22. Generally, the process 222 includes loading a first die into a first die plate of a swage machine such that the first die opens away from a grab plate of the swage machine (process block 224), loading a second die into a second die plate of the swage machine such that the second die opens away from the grab plate of the swage machine (process block 226), and loading a pipe fitting, a first pipe segment, and a second pipe segment into the swage machine such that a grab ring of the pipe fitting matingly interlocks with the grab plate of the swage machine (process block 228). Additionally, the process 222 includes engaging the second die with a first fitting jacket of the pipe fitting and the first die with a second fitting jacket of the pipe fitting (process block 230), operating a first swaging actuator to push the first die plate over the second fitting jacket in a first outwardly axial direction (process block 232), and operating a second swaging actuator to push the second die plate over the first fitting jacket in a second outwardly axial direction (process block 234).

Although described in a specific order, which corresponds with an embodiment of the present disclosure, it should be appreciated that the example process 222 is merely intended to be illustrative and non-limiting. In particular, in other embodiments, a process 222 for operating a swage machine 50 to concurrently swage multiple fitting jackets 44 of a pipe fitting 18 may include one or more additional process blocks and/or omit one or more of the depicted process blocks. Additionally or alternatively, in other embodiments, one or more of the depicted process blocks may be performed in a different order, for example, such that the pipe fitting 18 and the pipe segments 20 are loaded into the swage machine 50 before the first die 62 is loaded into the first die plate 202 and/or before the second die 62 is loaded into the second die plate 204.

In any case, as described above, a first one or more dies (e.g., die segments) 62 may be loaded (e.g., installed) in the first die plate 202 of the swage machine 50F in FIG. 20. In particular, as described above, the first die plate 202 may be implemented to enable the first one or more dies 62 to be loaded therein such that the first one or more dies 62 open away from the grab plate 52F of the swage machine 50F. As such, operating the swage machine 50F may include loading a first one or more dies 62 into its first die plate 202 such that the first one or more dies 62 open away from its grab plate 52F (process block 224). In some embodiments, the first one or more dies 62 may be secured in the first die plate 202 via one or more fasteners, such as a C-clamp.

Additionally, as described above, a second one or more dies (e.g., die segments) 62 may be loaded (e.g., installed) in the second die plate 204 of the swage machine 50F in FIG. 20. In particular, as described above, the second die plate 204 may be implemented to enable the second one or more dies 62 to be installed therein such that the second one or more dies 62 open away from the grab plate 52F of the swage machine 50F. As such, operating the swage machine 50F may include loading a second one or more dies 62 into its second die plate 204 such that the first one or more dies 62 open away from its grab plate 52F (process block 226). In some embodiments, the second one or more dies 62 may be secured in the second die plate 204 via one or more fasteners, such as a C-clamp.

Furthermore, as described above, the swage machine 50F of FIG. 20 includes a grab plate 52F with a grab tab 54, which is implemented (e.g., sized and/or shaped) to matingly interlock with a grab notch 56 on a grab ring 40 of a pipe fitting 18 to be swaged by the swage machine 50F. Furthermore, as described above, a pipe fitting 18 may be secured to a first pipe segment 20A at least in part by operating the swage machine 50F to conformally deform a first fitting jacket 44A of the pipe fitting 18 around first tubing 22A of the first pipe segment 20A and to a second pipe segment 20B at least in part by operating the swage machine 50F to conformally deform a second fitting jacket 44B of the pipe fitting 18 around second tubing 22B of the second pipe segment 20B. As such, operating the swage machine 50B may include loading a pipe fitting 18, a first pipe segment 20A to be secured to the pipe fitting 18, and a second pipe segment 20B to be secured to the pipe fitting 18 into the swage machine 50F such that the grab notch 56 on the grab ring 40 of the pipe fitting 18 matingly interlocks with the grab tab 54 on the grab plate 52F of the swage machine 50F (process block 228).

To facilitate swaging the pipe fitting 18, the swage machine 50F may then be operated to engage the second die 62 loaded in its second die plate 204 with a first fitting jacket 44A of the pipe fitting 18 and the first die 62 loaded in its first die plate 202 with a second fitting jacket 44B of the pipe fitting 18. As described above, in some embodiments, a die 62 of a swage machine 50 may be engaged with a portion of a pipeline system 10 that is loaded into the swage machine 50 at least in part by transitioning the swage machine 50 from its opened state in which its housing lid 96 is opened from its housing body 98 to its closed state in which its housing lid 96 is closed onto its housing body 98 (process block 236). Additionally or alternatively, as described above, a die 62 of a swage machine 50 may be engaged with a portion of a pipeline system 10 that is loaded into the swage machine 50 at least in part by operating a die actuator 108 secured to the die 62 to actuate the die 62 in an inwardly radial direction 113 (process block 238).

Furthermore, as described above, a first one or more swaging actuators 66 of the swage machine 50F may then be operated to push the first die plate 202 over the second fitting jacket 44B of the pipe fitting 18 in a first outwardly axial direction 160A away from the grab plate 52F (process block 232) while a second one or more swaging actuators 66 of the swage machine 50F are concurrently operated to push the second die plate 204 over the first fitting jacket 44A of the pipe fitting 18 in a second outwardly axial direction 160B away from the grab plate 52F (process block 234). In particular, as described above, in some embodiments, a first swaging actuator 66A of the first one or more swaging actuators 66 may be secured such that its actuator cylinder 68 is secured to the grab plate 52F of the swage machine 50F and its actuator piston 70 extends through the grab plate 52F and is secured to the first die plate 202 of the swage machine 50F. As such, to facilitate pushing the first die plate 202 over the second fitting jacket 44B of the pipe fitting 18, in such embodiments, fluid may be supplied to the actuator cylinder 68 of the first swaging actuator 66A to cause the actuator piston 70 of the first swaging actuator 66A to extend out farther from the actuator cylinder 68 of the first swaging actuator 66A.

Moreover, as described above, in some embodiments, a second swaging actuator 66B of the second one or more swaging actuators 66 may be secured such that its actuator cylinder 68 is secured to the grab plate 52F of the swage machine 50F and its actuator piston 70 extends through the grab plate 52F and is secured to the second die plate 204 of the swage machine 50F. As such, to facilitate pushing the second die plate 204 over the first fitting jacket 44A of the pipe fitting 18, in such embodiments, fluid may be supplied to the actuator cylinder 68 of the second swaging actuator 66B to cause the actuator piston 70 of the second swaging actuator 66B to extend out farther from the actuator cylinder 68 of the second swaging actuator 66B. In this manner, the present disclosure provides techniques for implementing and/or operating special-purpose deployment equipment—namely a swage machine—to facilitate securing a pipe fitting to the tubing of one or more pipe segments deployed or to be deployed in a pipeline system using swaging techniques, which, at least in some instances, may facilitate improving deployment efficiency of the pipeline system, for example, at least in part by obviating a manual swaging process.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A swage machine comprising:

a grab plate, wherein the grab plate comprises a grab tab configured to matingly interlock with a grab notch on a pipe fitting to facilitate securing the swage machine to the pipe fitting;

a support plate;

a die plate disposed between the grab plate and the support plate, wherein the die plate is configured to enable a set of die segments to be loaded in the swage machine such that the set of die segments opens away from the grab plate;

a support member secured to the grab plate and the support plate such that the support member enables the die plate to slide between the grab plate and the support plate; and a swaging actuator secured to the support plate and the die plate to enable the swaging actuator to facilitate pulling the die plate over a fitting jacket of the pipe fitting in an axial direction away from the grab plate via one or more retracting strokes to deform the fitting jacket of the pipe fitting around tubing of a pipe segment.

2. The swage machine of claim 1, comprising a plurality of die actuators, wherein:

the die plate comprises a plate rim; and each die actuator in the plurality of die actuators is secured between the plate rim of the die plate and a die segment in the set of die segments, wherein the plurality of die actuators is configured to:

retract the set of die segments toward the plate rim of the die plate to facilitate loading the pipe fitting into the swage machine, unloading the pipe fitting from the swage machine, or both; and extend the set of die segments away from the plate rim of the die plate to facilitate engaging the set of die segments with the fitting jacket of the pipe fitting to enable the set of die segments to be used to deform the fitting jacket of the pipe fitting around the tubing of the pipe segment.

3. The swage machine of claim 2, wherein the plurality of die actuators is configured to adjust an inner surface diameter of the set of die segments to enable the set of die segments to be used to deform fitting jackets with different diameters.

4. The swage machine of claim 1, wherein the support member comprises a housing secured to the grab plate and the support plate such that the housing enables the die plate to slide between the grab plate and the support plate.

5. The swage machine of claim 4, wherein the housing comprises:

a housing body; and a housing lid pivotably connected to the housing body via a hinge, wherein the housing lid is configured to be:

opened from the housing body to facilitate loading the pipe fitting into the swage machine, unloading the pipe fitting from the swage machine, or both; and closed onto the housing body to facilitate engaging the set of die segments loaded in the die plate with the fitting jacket of the pipe fitting to enable the set of die segments to be used to deform the fitting jacket of the pipe fitting around the tubing of the pipe segment.

6. The swage machine of claim 1, wherein the swaging actuator is configured to facilitate pushing the die plate in an opposite axial direction toward the grab plate via one or more extending strokes after the fitting jacket of the pipe fitting is deformed around the tubing of the pipe segment.

7. The swage machine of claim 1, wherein the support member comprises a support rod secured to the grab plate and the support plate such that the support rod extends through the die plate to enable the die plate to slide between the grab plate and the support plate.

8. The swage machine of claim 1, wherein the swaging actuator comprises:

an actuator cylinder secured to an inner surface of the support plate between the support plate and the die plate; and an actuator piston secured to the die plate.

9. The swage machine of claim 1, wherein the swaging actuator comprises:

an actuator cylinder secured to an outer surface of the support plate; and an actuator piston that extends through the support plate and is secured to the die plate.

10. The swage machine of claim 1, comprising:

another support plate;

another die plate disposed between the grab plate and the another support plate, wherein:

the another die plate is configured to enable another set of die segments to be loaded in the swage machine such that another set of die segments opens away from the grab plate; and the support member is secured to the grab plate and the another support plate such that the support member enables the another die plate to slide between the grab plate and the another support plate; and another swaging actuator secured to the another die plate and the another support plate to enable the another swaging actuator to facilitate pulling the another die plate over another fitting jacket of the pipe fitting in an opposite axial direction toward the grab plate via one or more retracting strokes to deform the another fitting jacket of the pipe fitting around other tubing of another pipe segment.

* * * * *